US007537441B2

(12) United States Patent
Iwasaki

(10) Patent No.: US 7,537,441 B2
(45) Date of Patent: May 26, 2009

(54) GEAR PUMP AND LIQUID INJECTION APPARATUS

(75) Inventor: Mitsutaka Iwasaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 563 days.

(21) Appl. No.: 11/002,209

(22) Filed: Dec. 3, 2004

(65) Prior Publication Data

US 2005/0238505 A1 Oct. 27, 2005

(30) Foreign Application Priority Data

Dec. 4, 2003 (JP) ..... 2003-406044
Apr. 12, 2004 (JP) ..... 2004-116832

(51) Int. Cl.
*F01C 1/18* (2006.01)

(52) U.S. Cl. ..... 418/206.6; 418/205

(58) Field of Classification Search ..... None
See application file for complete search history.

(56) References Cited

U.S. PATENT DOCUMENTS 3,395,646 A * 8/1968 Gelin ..... 418/133
3,881,849 A * 5/1975 Commarmot et al. ..... 418/182
4,553,915 A * 11/1985 Eley ..... 418/102
5,244,367 A * 9/1993 Aslin ..... 418/104

FOREIGN PATENT DOCUMENTS

| | | | |
|---|---|---|---|
| JP | 57-156090 | U | 9/1982 |
| JP | 60-83074 | U | 6/1985 |
| JP | 2-144684 | U | 12/1990 |
| JP | 8-93657 | A | 4/1996 |
| JP | 9-14154 | A | 1/1997 |
| JP | 10-30578 | A | 2/1998 |
| JP | 11-13642 | A | 1/1999 |
| JP | 11-182455 | A | 7/1999 |
| JP | 11-247767 | A | 9/1999 |
| JP | 2000-161248 | A | 6/2000 |

* cited by examiner

*Primary Examiner*—Thomas Denion
*Assistant Examiner*—Douglas J. Duff
(74) *Attorney, Agent, or Firm*—Sughrue Mion, PLLC

(57) ABSTRACT

A high-performance gear pump that does not require highly accurate machining is disclosed. The gear pump includes a housing having an accommodation chamber. A drive gear and a driven gear are positioned in contact with an inner surface of the accommodation chamber. The drive shaft is loosely received by the shaft hole of the drive gear, and the driven shaft is loosely received by the shaft support formed in the housing and the cover.

10 Claims, 17 Drawing Sheets

GEAR PUMP AND LIQUID INJECTION APPARATUS

CROSS-REFERENCE TO RELATED APPLICATIONS

This application is based upon and claims the benefit of priority from prior Japanese Patent Application No. 2003-406044, filed on Dec. 4, 2003, and Japanese Patent Application No. 2004-116832, filed on Apr. 12, 2004, the entire contents of which are incorporated herein by reference.

BACKGROUND OF THE INVENTION

The present invention relates to a gear pump and a liquid injection apparatus incorporating a gear pump.

A gear pump is generally superior to other types of pumps in that it has a simple configuration. FIG. 1 shows a conventional gear pump 100. The gear pump 100 has a drive gear 103 and a driven gear 104 accommodated in an accommodation chamber 102, which is formed in a housing 101 (refer to, for example, Japanese Laid-Open Patent Publication No. 8-093657). The drive gear 103 and the driven gear 104 are rotatably supported by rotation shafts 105 and 106, respectively. A suction chamber 110 and a discharge chamber 112 are defined in the accommodation chamber 102.

The rotation shaft 105 extends through a shaft hole (not shown) formed in the housing 101 and is received by a shaft hole 107 of the drive gear 103. Part of the rotation shaft 105 projects out of the housing 101. The rotation shaft 106 is received by a shaft hole 108 formed in a central part of the driven gear 104 and a shaft hole (not shown) of the housing 101.

When the drive gear 103 and the driven gear 104 are rotated, the liquid in the suction chamber 110 is transferred while being enclosed in the space defined by the teeth of the drive gear 103 and the inner surface 111 of the accommodation chamber 102 and the space defined by the teeth of the driven gear 104 and the inner surface 111 of the accommodation chamber 102 to be sequentially discharged to the discharge chamber 112.

In the prior art, the liquid may flow back from the discharge chamber 112 to the accommodation chamber 102 or leak from gaps between components inside the gear pump 100. This would lower the pumping efficiency of the liquid. The pumping efficiency of the liquid may be improved by machining the gears 103 and 104 and the housing 101 with accuracy so as to minimize the gaps between each of the gears 103 and 104 and the accommodation chamber 102. However, the machining of the gears 103 and 104 and the housing 101 with high accuracy increases the manufacturing cost and the number of manufacturing steps.

SUMMARY OF THE INVENTION

The present invention provides a gear pump, which is compact and easy to manufacture and has a high capability for discharging liquid, and a liquid injection apparatus including such gear pump.

One aspect of the present invention provides a gear pump. The gear pump is provided with a housing including an accommodation chamber and a shaft hole. A drive shaft is rotatably supported by the shaft hole. A drive gear is accommodated in the accommodation chamber and rotated by the drive shaft. The drive gear includes a shaft hole for receiving the drive shaft and teeth that slide along an inner surface of the accommodation chamber when rotated. A driven gear is accommodated in the accommodation chamber and includes teeth engaging with the teeth of the drive gear and sliding along the inner surface of the accommodation chamber when rotated. When the drive shaft is attached to the shaft hole of the drive gear, a gap is formed between the shaft hole of the drive gear and the drive shaft.

Another aspect of the present invention is a gear pump. The gear pump is provided with a housing including an accommodation chamber and a support hole. A drive shaft is rotatably supported by the support hole. A drive gear is accommodated in the accommodation chamber and rotated by the drive shaft. The drive gear includes a shaft hole for receiving the drive shaft and teeth that slide along an inner surface of the accommodation chamber when rotated. A driven gear is accommodated in the accommodation chamber and includes teeth engaging with the teeth of the drive gear and sliding along the inner surface of the accommodation chamber when rotated. A sealing plate seals the accommodation chamber. A shaft support, formed in the housing and the sealing plate, rotatably supports a driven shaft of the driven gear. When the driven shaft is attached to the shaft support, a gap is formed between the shaft support and the driven shaft.

A further aspect of the present invention is a gear pump for discharging fluid. The gear pump is provided with a housing defining an accommodation chamber including an opening. The fluid flows into the accommodation chamber at a suction position and flows out of the accommodation chamber at a discharge position. A drive gear and a driven gear are arranged in the accommodation chamber to transfer the fluid from the suction position to the discharge position when rotated. A first sealing element, contacting at least part of the drive gear and the driven gear, closes the opening of the accommodation chamber and prevents the fluid from flowing back to the suction position from the discharge position. A second sealing element, arranged at an outer side of the first sealing element, seals the accommodation chamber in a hermetic state.

BRIEF DESCRIPTION OF THE DRAWINGS

The invention, together with objects and advantages thereof, may best be understood by reference to the following description of the presently preferred embodiment together with the accompanying drawings in which.

DETAILED DESCRIPTION OF THE PREFERRED EMBODIMENTS

Figure 1:
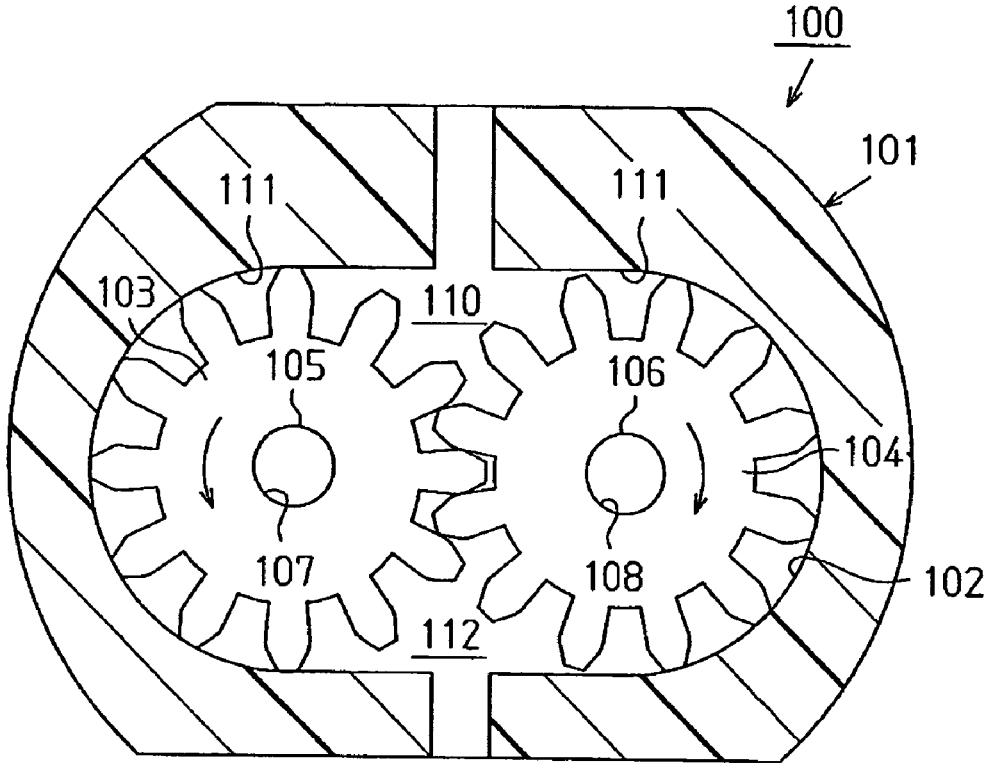
Fig. 1 (Prior Art)
FIG. 1 is a cross-sectional view of a conventional gear pump.
Figure 2:
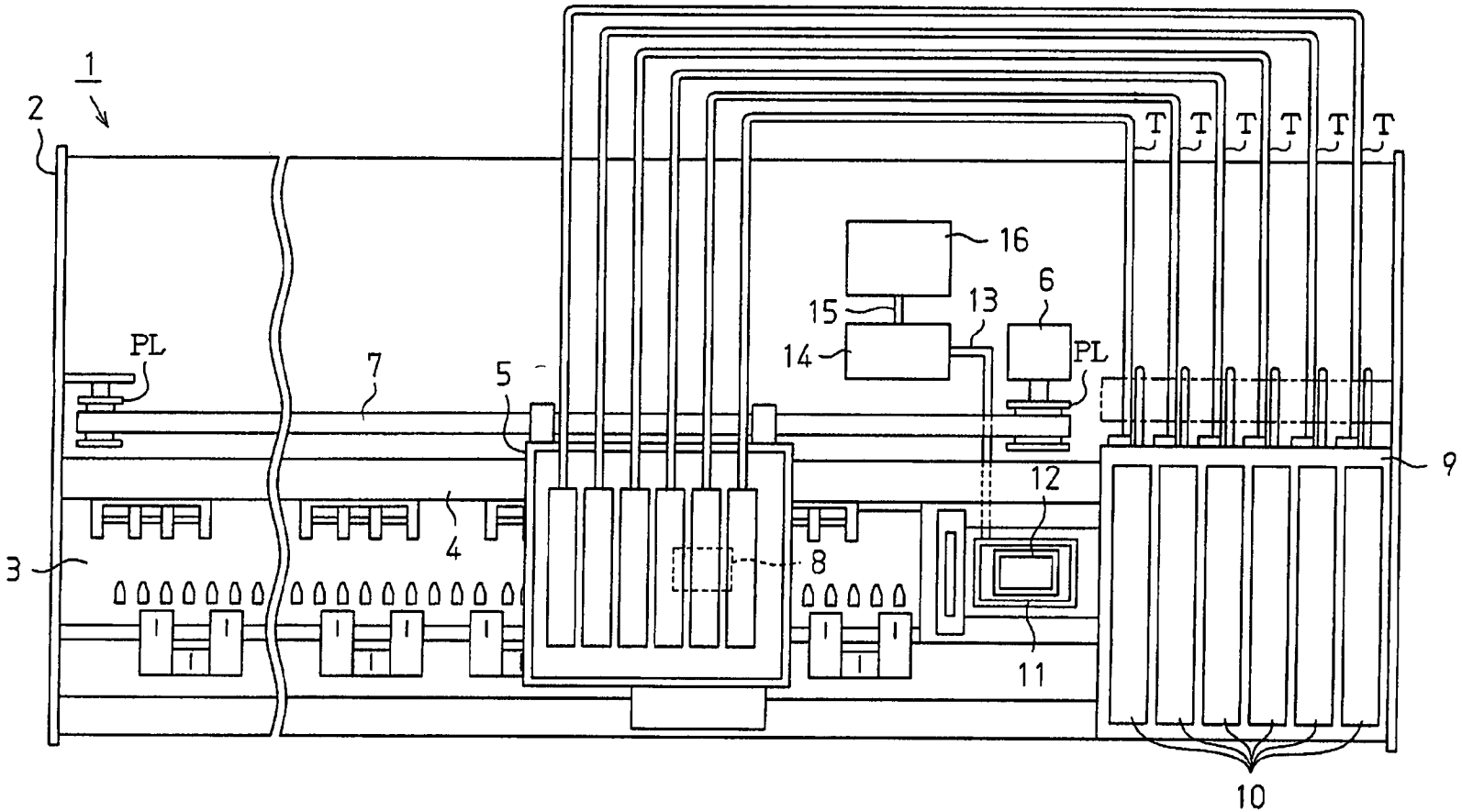
FIG. 2 is a schematic plan view showing a printer incorporating a gear pump according to a first embodiment of the present invention.

A liquid injection apparatus incorporating a gear pump according to a first embodiment of the present invention will now be described. FIG. 2 is a schematic plan view of an ink jet recording device (printer) serving as the liquid injection apparatus.

The printer includes a frame 2 having a generally box-like shape. A platen 3 is arranged in the frame 2 and a recording paper (not shown) serving as a target is fed to the platen 3 by a paper feeding mechanism (not shown).

A guide member 4 is arranged on the frame 2 so as to be parallel to the longitudinal direction of the platen 3. A carriage 5 movable along the guide member 4 is supported by the guide member 4. A carriage motor 6 is attached to the frame 2. The carriage motor 6 drives the carriage 5 with a timing belt 7 wound along a pair of pulleys PL. When the carriage motor 6 is driven, the driving force of the carriage motor 6 is transmitted to the carriage 5 by the timing belt 7, and the carriage 5 reciprocates in a direction parallel to the longitudinal direction of the platen 3 while being supported by the guide member 4.

A recording head 8 serving as a liquid injection head is arranged on a lower surface (surface facing the platen 3) of the carriage 5. Nozzles are formed in a lower surface of the recording head 8 facing the platen 3.

The frame 2 includes a cartridge case 9. Ink cartridges 10 (six in the first embodiment) serving as a liquid storage portion is attached to the cartridge case 9. The plurality of ink cartridges 10 store a plurality of inks. A pressurizing pump (not shown) pressurizes the inks supplied from the plurality of ink cartridges 10 to the recording head 8 through a corresponding tube T.

The recording head 8 includes a piezoelectric element (not shown) for pressurizing the ink. The nozzles of the recording head discharge droplets of pressurized ink towards the recording paper.

A cap holder 11 for holding a box shaped cap 12, which is made of a flexible member, is arranged in a non-printing region of the frame 2. The cap holder 11 holds the cap 12 so that an opening of the cap 12 faces a nozzle surface of the recording head 8. The cap holder 11 is driven by a drive mechanism (not shown) when the printer 1 is in a non-printing state to closely contact the cap 12 to the nozzle surface to prevent the vicinity of the nozzles from drying.

A suction port (not shown) connecting the interior and exterior of the cap 12 is formed in the cap 12. A tube 13 connects the suction port to a pump unit 14 arranged in the frame 2. The pump unit 14 is connected to a waste ink tank 16 by a tube 15. When the cap 12 seals the nozzle surface and the pump unit 14 is driven, the space defined by the cap 12 and the nozzle surface is depressurized so as to draw in the air and ink in the space. This draws in ink with high viscosity, air bubbles, ink collected on the nozzle surface, and dust that remain in the nozzle of the recording head 8 to clean the recording head 8. The ink and the like drawn from the recording head 8 is sent to the waste ink tank 16 by way of the pump unit 14.

Figure 3:
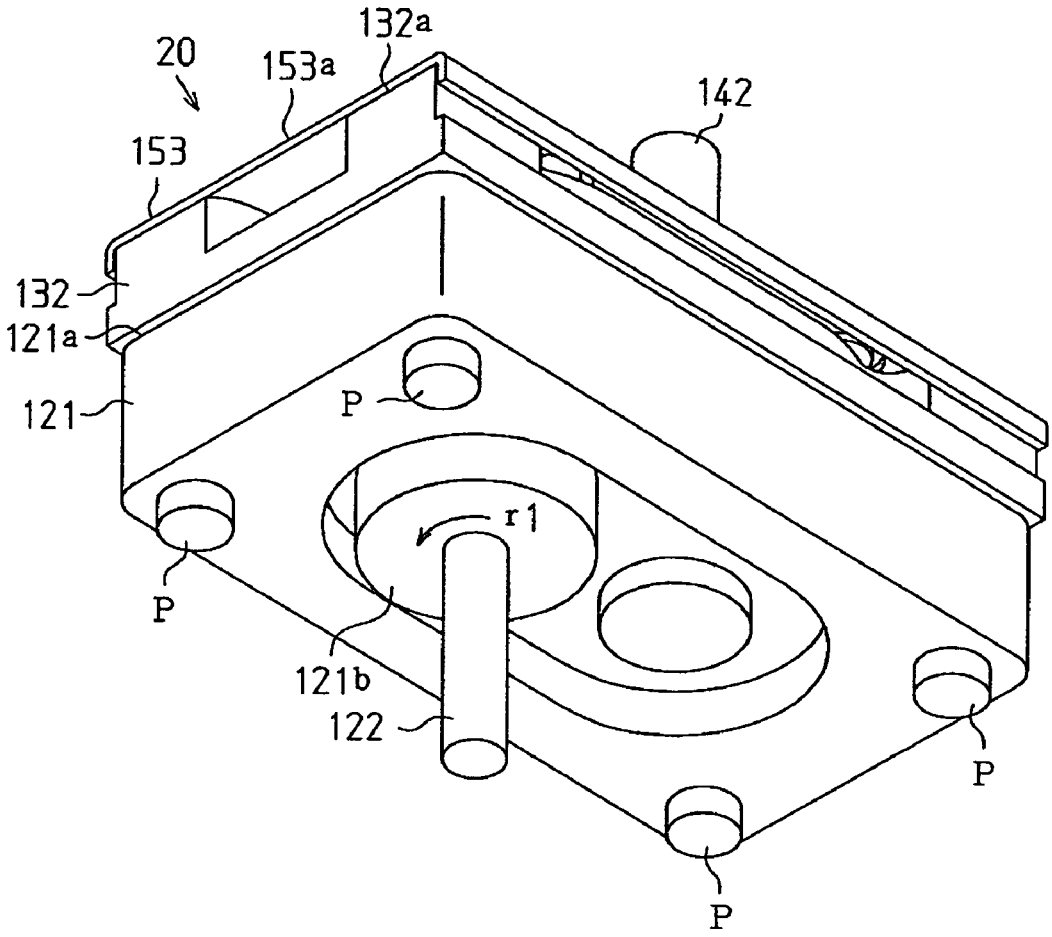
FIG. 3 is a perspective view showing the gear pump of FIG. 2.

The pump unit 14 includes a drive motor (not shown), a drive mechanism, and a gear pump 20 (refer to FIG. 3). When the drive motor is driven, the gear pump 20 is driven by the drive mechanism.

Figure 4:
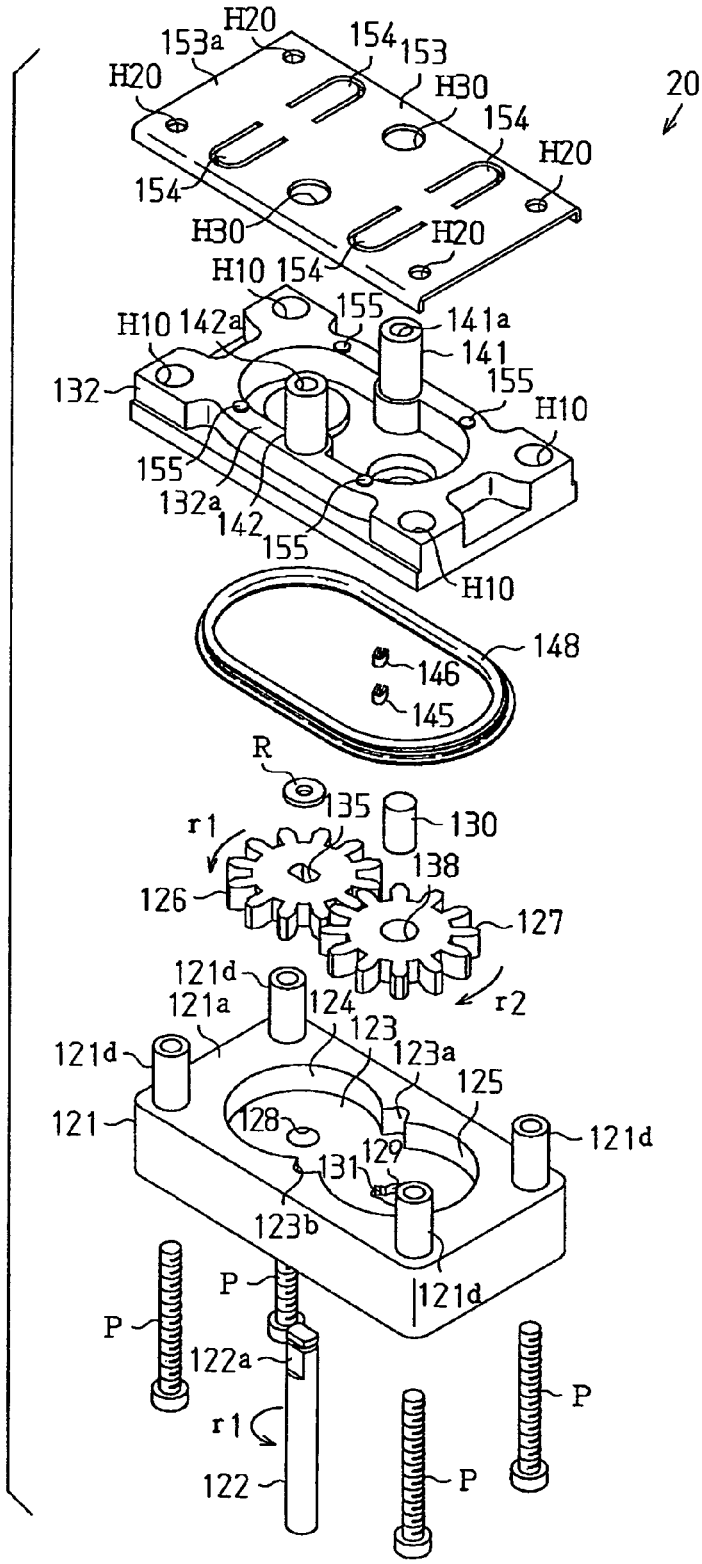
FIGS. 4 and 5 are exploded perspective views showing the gear pump of FIG. 2.
Figure 5:
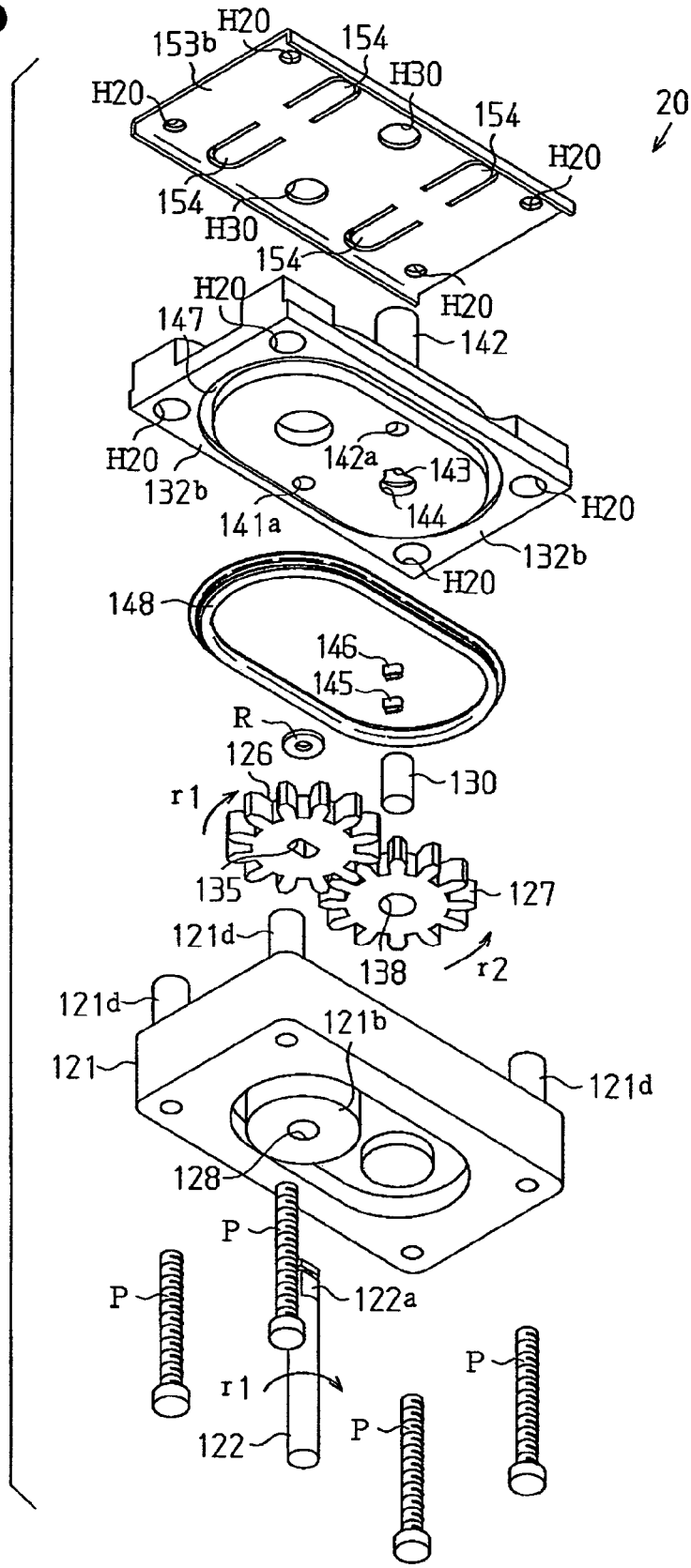
Figure 6:
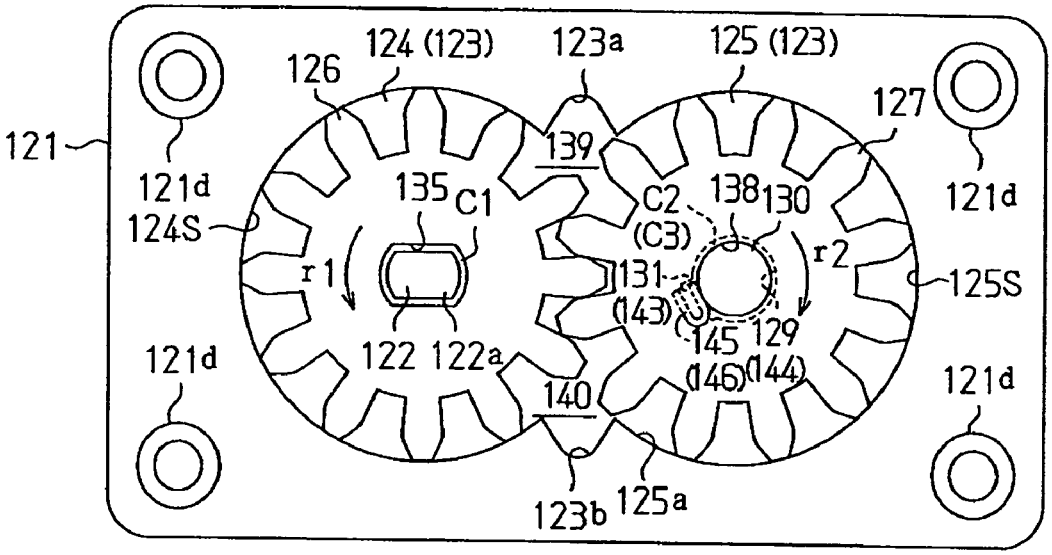
FIGS. 6 and 7 are plan views showing the internal structure of the gear pump of FIG. 2.
Figure 7:
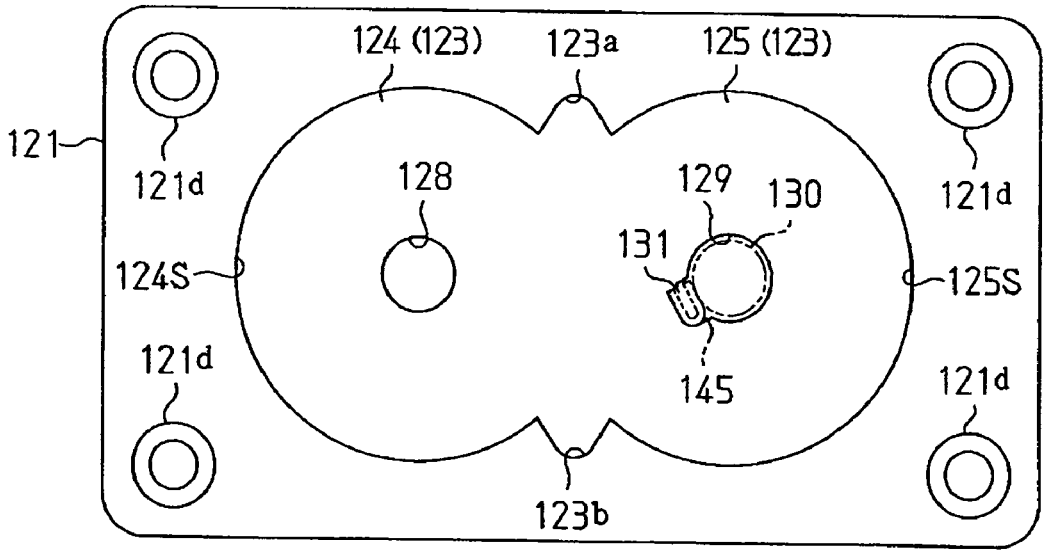

The gear pump 20 arranged in the pump unit 14 will now be described. FIG. 3 is a perspective view of the gear pump 20, and FIGS. 4 and 5 are exploded perspective views of the gear pump 20. FIGS. 6 and 7 are plan views showing an internal portion of the gear pump 20. FIG. 6 shows a state in which the gears are accommodated, and FIG. 7 shows a state in which the gears are not accommodated.

As shown in FIG. 3, the gear pump 20 includes a housing 121. A shaft seat 121*b* is formed on an external surface of the housing 121. The shaft seat 121*b* rotatably supports a drive shaft 122. The drive shaft 122 is coupled to a drive mechanism including the drive motor. The drive motor rotates the drive shaft 122 in the r1 direction to rotate a drive gear 126 (see FIG. 4) in the housing 121.

As shown in FIG. 4, the housing 121 has a generally box-like shape. The housing 121 includes an accommodation chamber (accommodation recess) that opens at the upper surface 121*a*. The accommodation chamber 123 includes a first accommodation portion 124 and a second accommodation portion 125. The accommodation portions 124 and 125 are each generally cylindrical. The first and the second accommodation portions 124 and 125 partially overlap each other. A suction portion 123*a* and a discharge portion 123*b* are defined between the first accommodation portion 124 and the second accommodation portion 125 in the housing 121.

As shown in FIG. 7, a shaft hole 128 is formed in the bottom surface of the first accommodation portion 124. The shaft hole 128 rotatably supports the drive shaft 122. A shaft support 129 is formed in the bottom surface of the second accommodation portion 125. The shaft support 129 supports the lower end of a driven shaft 130 for a driven gear 127. The inner diameter of the shaft support 129 is greater than the outer diameter of the driven shaft 130 for the driven gear 127. In the first embodiment, the shaft hole 128 is a through hole, and the shaft support 129 is a recess. A groove 131 extending continuously from the shaft support 129 is formed in the bottom surface of the second accommodation portion 125.

A screw socket 121*d* is formed in each of the four corners in the upper surface 121*a* of the housing 121. Each screw socket 121*d* is cylindrical so as to receive a screw P.

The drive gear 126 and the driven gear 127 will now be described. As shown in FIGS. 4 to 6, the central portion of the drive gear 126 includes a shaft hole 135. The shaft hole 135 receives a distal end portion 122*a* of the drive shaft 122. As shown in FIGS. 4 and 6, the distal end portion 122*a* of the drive shaft 122 is a rectangular column. The portion excluding the rectangular columnar distal end portion 122*a* is cylindrical. The shaft hole 135 is a rectangular hole that is in accordance with the shape of the distal end portion 122*a*. As shown in FIG. 6, the inner diameter of the shaft hole 135 is greater than the outer diameter of the distal end portion 122*a* of the drive shaft 122. Therefore, when the drive shaft 122 is attached to the drive gear 126, a small amount of idle space (clearance) is formed between the distal end portion 122*a* of the drive shaft 122 and the shaft hole 135. The dimension of the shaft hole 135 is determined so that when the distal end portion 122*a* of the drive shaft 122 rotates in the shaft hole 135 over a predetermined angle, the corners of the distal end portion 122*a* are engaged with the shaft hole 135 to transmit the rotation of the drive shaft 122 to the drive gear 126. As shown in FIG. 4 and FIG. 6, the central portion of the driven gear 127 includes a shaft hole 138. The shaft hole 138 is substantially circular and rotatably receives the cylindrical driven shaft 130.

As shown in FIG. 6, the drive gear 126 and the driven gear 127 are accommodated in the first accommodation portion 124 and the second accommodation portion 125, respectively, in a state meshed with each other. A suction chamber 139 and a discharge chamber 140 are defined by the accommodation chamber 123, the drive gear 126, and the driven gear 127. That is, the space surrounded by the drive gear 126, the driven gear 127, and the suction portion 123*a* is the suction chamber 139 in which the ink externally flowing to the gear pump 20 is temporarily stayed. The space surrounded by the drive gear 126, the driven gear 127, and the discharge portion 123*b* is the discharge chamber 140 in which ink discharged from the suction chamber 139 by the rotation of the drive gear 126 and the driven gear 127 is temporarily stayed.

The drive gear 126 is positioned by contact between the tip of each tooth of the drive gear 126 with the inner surface 124S of the first accommodation portion 124 (interior of the accommodation chamber 123). The distal end portion 122*a* of the drive shaft 122 is inserted into the shaft hole 135 of the positioned drive gear 126. Since the shaft hole 135 is greater than the outer diameter of the distal end portion 122*a* of the drive shaft 122, a clearance C1 is formed between the shaft hole 135 and the distal end portion 122*a* of the drive shaft 122 fitted to the shaft hole 135. The clearance C1 compensates for displacement of the shaft hole 128 of the housing 121 relative to the shaft hole 135 of the drive gear 126. That is, the drive gear 126 is not positioned by the drive shaft 122 but positioned by the inner surface 124S of the first accommodation portion 124. Thus, although displacement may occur due to molding error and the like between the shaft hole 128 of the housing 121 and the shaft hole 135, the drive shaft 122 received by the shaft hole 128 absorbs the displacement in the shaft hole 135 since the shaft hole 135 is larger by an amount corresponding to clearance C1. The drive shaft 122 received by the shaft hole 135 is coupled to the drive gear 126 in an irremovable manner by attaching a seal ring R (refer to FIG. 4 and FIG. 5) to the distal end portion 122*a*.

The driven gear 127 is positioned by contact between the tip of each tooth and the inner surface 125S of the second accommodation portion 125 (interior of the accommodation chamber 123). The driven shaft 130 is rotatably inserted into the shaft hole 138 of the positioned driven gear 127, and the lower end of the driven shaft 130 is supported by the shaft support 129 of the housing 121. As mentioned above, the inner diameter of the shaft support 129 is greater than the outer diameter of the driven shaft 130. Thus, a clearance C2 is formed between the driven shaft 130 and the shaft support 129 (see FIG. 6). The clearance C2 compensates for displacement of the shaft support 129 of the housing 121 relative to the driven shaft 130 of the driven gear 127. That is, the driven gear 127 is not positioned by the driven shaft 130 but positioned by contact with the inner surface 125S of the second accommodation portion 125. Displacement caused by a molding error and the like is likely to occur between the shaft support 129 of the housing 121 and the driven shaft 130 received by the driven gear 127. However, such displacement is absorbed by movement of the driven shaft 130 within the shaft support 129, which is larger by an amount corresponding to clearance C2. Further, a pressing spring 145 serving as a biasing means is press-fitted to the groove 131. The pressing spring 145 is substantially U-shaped, and biases the driven shaft 130 away from the discharge chamber 140 (discharge position).

The housing 121 accommodating the drive gear 126 and the driven gear 127 is sealed by a cover 132 serving as a sealing plate. As shown in FIG. 4, the cover 132 includes a suction pipe 141 and a discharge pipe 142 projecting from the upper surface 132*a*. The suction pipe 141 and the discharge pipe 142 include center holes 141*a* and 142*a*, respectively. The center holes 141*a* and 142*a* are formed so as to correspond to the position of the suction chamber 139 and the discharge chamber 140, respectively, when the cover 132 seals the housing 121. The suction pipe 141 is connected to the tube 13, which is connected to the cap 12, and the ink discharged from the cap 12 flows into the suction chamber 139 of the gear pump 20 through the suction pipe 141. The discharge pipe 142 is connected to the tube 15, which is connected to the waste ink tank 16, and the ink in the discharge chamber 140 is sent to the waste ink tank 16 through the discharge pipe 142. Further, four projections 155 are formed on the upper surface 132*a* of the cover 132. The projections 155 are circular and are pressed by contact with a cover pressing spring 153, which will be described later.

As shown in FIG. 5, a press-fit groove 147 is formed in the lower surface 132*b* of the cover 132. An annular seal 148 is press-fitted into the press-fit groove 147. The seal 148 includes a flexible member made of elastomer or the like. When the cover 132 is attached to the housing 121, the seal 148 is adhered to the housing 121 and seals the accommodation chamber 123.

As shown in FIG. 5, a shaft support 144 is formed at the lower surface 132*b* of the cover 132. In the same manner as the shaft support 129 formed in the housing 121, the shaft support 144 supports the upper end of the driven shaft 130. The inner diameter of the shaft support 144 is greater than the outer diameter of the driven shaft 130. Therefore, the driven shaft 130 is received by the shaft support 144 with a clearance C3 (see FIG. 6). A groove 143 extending continuously from the shaft support 144 is formed in the cover 132. A pressing spring 146 serving as a biasing means is press-fitted in the groove 143. The pressing spring 146, which is substantially U-shaped, biases the driven shaft 130 away from the discharge chamber 140.

As shown in FIG. 3, the cover pressing spring 153 is attached to the upper surface of the cover 132 (side of the upper surface 132*a*). As shown in FIGS. 4 and 5, the cover pressing spring 153 is plate-shaped and has two opposing sides that are bent along the cover 132. Holes H30 for receiving the suction pipe 141 and the discharge pipe 142 of the cover 132 are formed in the generally middle portion of the cover pressing spring 153. Generally U-shaped slits, or four spring portions 154 are formed in four locations at opposite sides of the holes H30 in the cover pressing spring 153. When the cover pressing spring 153 is attached to the cover 132, the spring portions 154 are each pushed upward by each of the projections 155 on the cover 132 and elastically deflected. The cover 132 presses and contacts the housing 121 with the reaction force of the spring portions 154.

Holes H10 and H20 are formed in the four corners of the cover 132 and the cover pressing spring 153, respectively.

Fastening member (not shown), such as nuts, are attached to the distal ends of the four screws P extending through the housing 121 and the holes H10 and H20. This fixes the cover 132 and the cover pressing spring 153 to the housing 121.

The operation of the gear pump 20 when cleaning the recording head 8 will now be described. During head cleaning, the cap holder 11 is driven to seal the nozzle surface of the recording head 8 with the cap 12. In response to a predetermined timing drive signal provided from a control section (not shown) of the printer 1, the drive motor is driven and the drive shaft 122 is rotated in the r1 direction. When the drive shaft 122 is rotated in the r1 direction, the distal end portion 122*a* of the drive shaft 122 engages with the shaft hole 135 of the drive gear 126 and rotates the drive gear 126 in the r1 direction. The driven gear 127 is then rotated in the r2 direction due to the meshing with the drive gear 126.

When the drive gear 126 and the driven gear 127 are rotated, the ink accommodated in the suction chamber 139 is enclosed in the space defined by the grooves between the teeth and the inner surfaces 124S and 125S of the accommodation chamber 123 and is sequentially sent to the discharge chamber 140. Thus, the suction chamber 139 enters a low-pressure state. Due to the pressure difference between the suction chamber 139 and the cap 12, the ink and air in the cap 12 flows into the suction chamber 139 by way of the tube 13. The ink is sequentially sent from the suction chamber 139 to the discharge chamber 140. Thus, the suction chamber 139 is constantly in the low-pressure state while the discharge chamber 140 is in a state in which the pressure is higher than the suction chamber 139.

Therefore, when the drive gear 126 and the driven gear 127 are rotated, ink having low pressure in the suction chamber 139 is enclosed in the space defined by the grooves between the teeth and the inner surfaces 124S and 125S of the accommodation chamber 123 and sent to the discharge chamber 140. When the teeth tips of the driven gear 127 move away from an edge portion 125*a* (see FIG. 6) of the inner surface 125S of the second accommodation portion 125, a sudden flow of the ink tends to occur in the vicinity of the discharge chamber 140 due to the pressure difference between the space and the discharge chamber 140. However, since the driven shaft 130 is biased away from the discharge chamber 140 by the pressing springs 145 and 146, the driven shaft 130 resists being moved towards the shaft supports 129 and 144. Conversely, the drive gear 126 moves towards the discharge chamber 140. However, friction caused by engagement with the drive shaft restricts movement of the drive gear 126 toward the drive shaft 122.

The first embodiment has the advantages described below.

(1) The drive gear 126 is positioned by contact with the inner surface 124S of the first accommodation portion 124 formed in the housing 121. Further, the clearance C1 is formed between the drive shaft 122 and the shaft hole 135 due to the shaft hole 135 that is larger than the outer diameter of the distal end portion 122*a* of the drive shaft 122. If the shaft hole 128 of the housing 121 is misaligned with respect to the shaft hole 135 due to, for example, molding error, the drive shaft 122 inserted into the shaft hole 128 absorbs the misalignment in the shaft hole 135 even if the clearance formed between the drive gear 126 and the inner surface 124S is not large so that the drive gear 126 and the inner surface 124S come into contact to be positioned. Thus, the drive shaft 122 is fitted to the shaft hole 128 of the housing 121 and the shaft hole 135 of the drive gear 126 without machining the drive gear 126, the housing 121, and the like with high precision. Further, since a large clearance does not need to be formed between the drive gear 126 and the inner surface 124S, the seal of the space defined by the teeth grooves of the drive gear 126 and the inner surface 124S is ensured. That is, the pumping performance of the gear pump 20 is enhanced without machining the components with high accuracy. Further, the gear pump 20 is not enlarged.

(2) The driven gear 127 is positioned by contact with the inner surface 125S of the second accommodation portion 125. Further, the shaft supports 129 and 144 for supporting the driven shaft 130 inserted into the driven gear 127 are larger than the outer diameter of the driven shaft 130, and the driven shaft 130 is inserted to the shaft supports 129 and 144 with clearances C2, C3. That is, when molding error and the like causes displacement of the driven shaft 130 relative to the shaft supports 129 and 144 of the housing 121, the driven shaft 130 absorbs the displacement within the shaft supports 129 and 144 without forming a large clearance between the driven gear 127 and the inner surface 125S of the second accommodation portion 125. This positions the driven gear 127 and the inner surface 125S in a state contacting each other. Thus, the driven shaft 130 is fitted to the shaft supports 129 and 144 without processing the driven gear 127, the housing 121 and the like with high accuracy. Further, a large clearance does not need to be formed between the driven gear 127 and the inner surface 125S. This ensures the seal of the space defined by the teeth grooves of the driven gear 127 and the inner surface 125S.

(3) The grooves 131 and 143 are formed continuously from the shaft supports 129 and 144 for supporting the driven shaft 130 of the driven gear 127. The pressing springs 145 and 146 are press-fitted into the grooves 131 and 143, respectively. The pressing springs 145 and 146 bias the driven shaft 130 away from the discharge chamber 140. Thus, even when the teeth tips of the driven gear 127 move away from the edge portion 125*a* of the inner surface 125S in the second accommodation portion 125 so as to discharge the ink accommodated in the teeth grooves, the driven shaft 130 is prevented from being displaced due to the biasing of the pressing springs 145 and 146. That is, even if the driven shaft 130 is fitted into the shaft supports 129 and 144 of the housing 121 with clearances C2 and C3, the driven gear 127 is prevented from vibrating.

A gear pump 20 according to a second embodiment of the present invention will now be described with reference to FIGS. 8 to 23.

Figure 8:
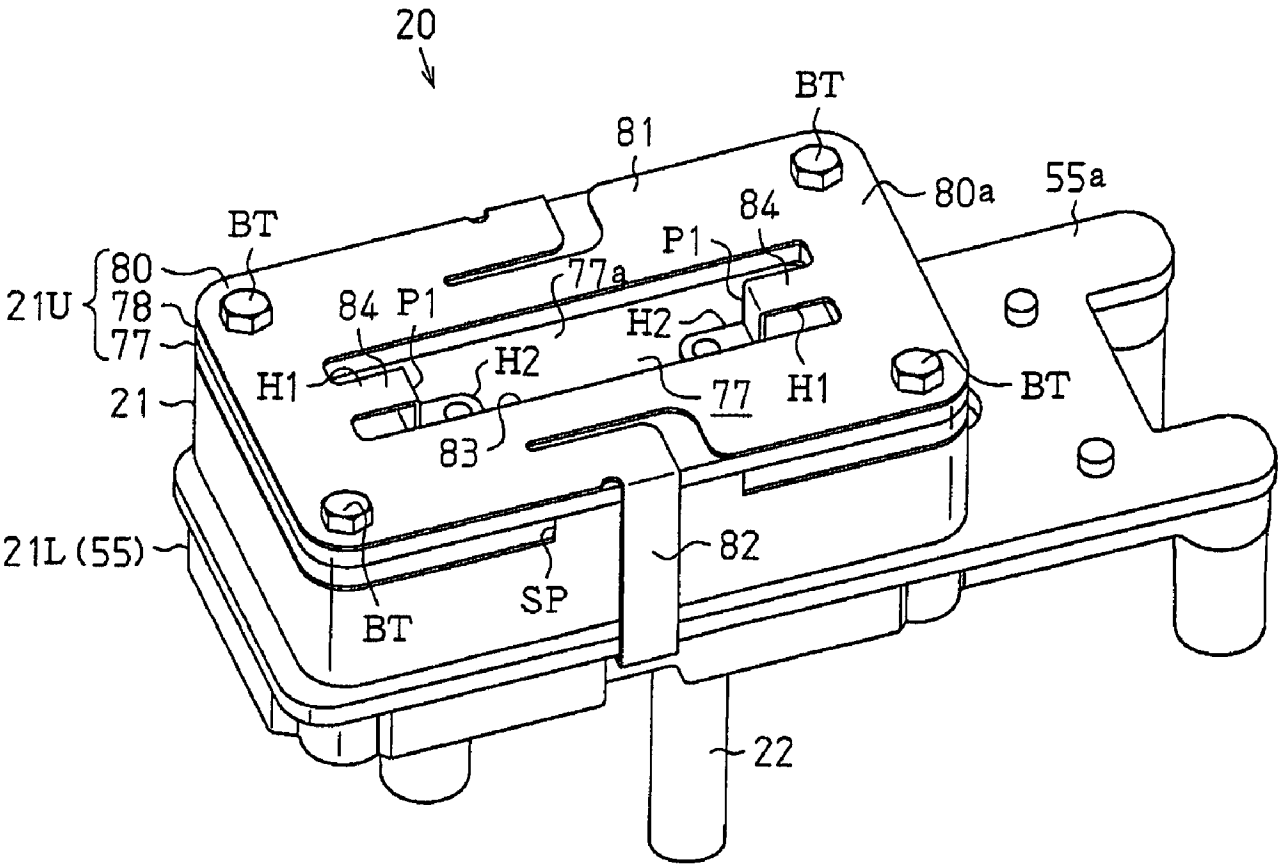
FIG. 8 is a perspective view of a gear pump according to a second embodiment of the present invention.
Figure 9:
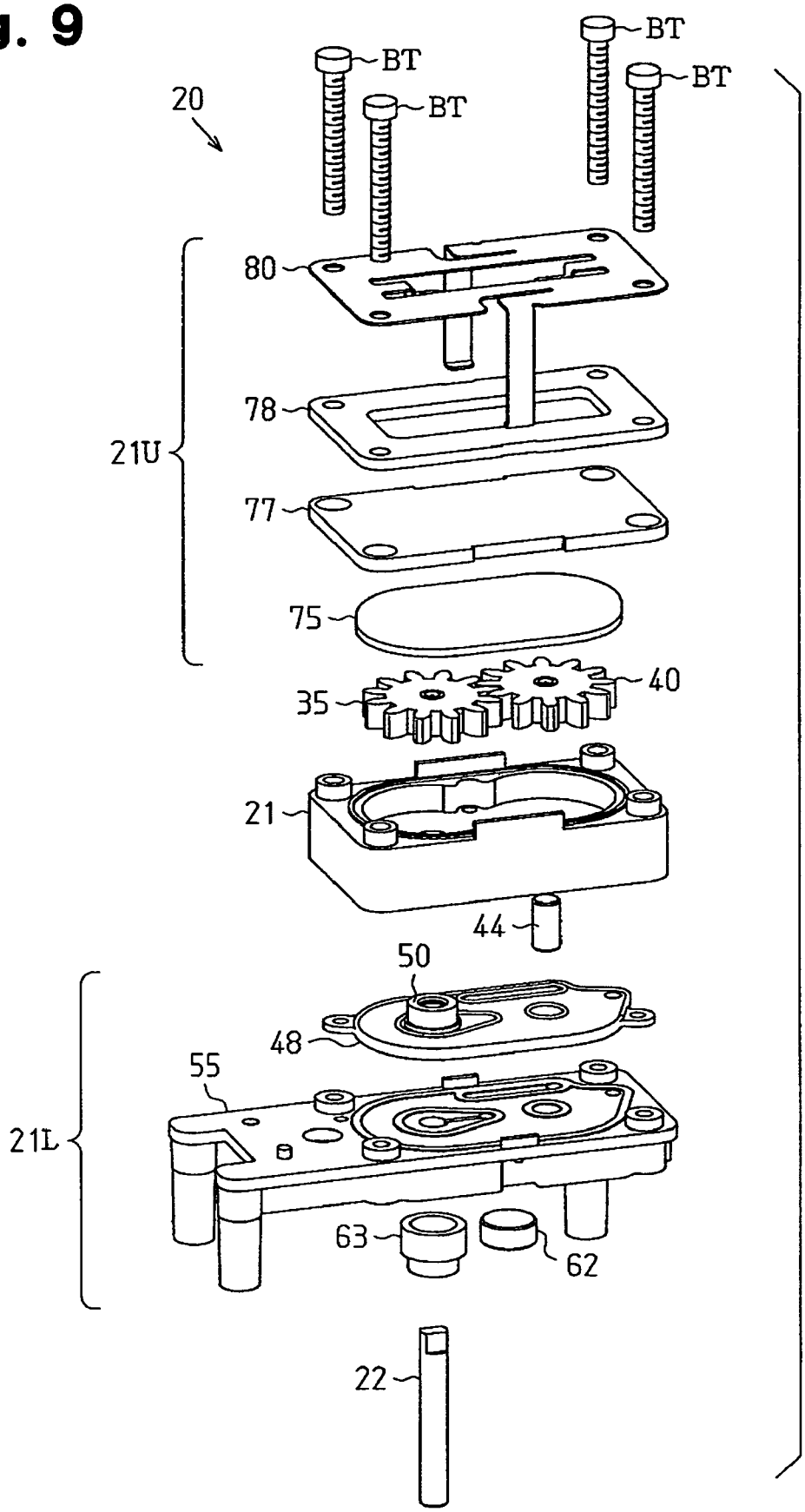
FIG. 9 is an exploded perspective view showing the gear pump of FIG. 8.

FIG. 8 is an entire perspective view of the gear pump 20, and FIG. 9 is an exploded perspective view of the gear pump 20. As shown in FIG. 8, the gear pump 20 includes a housing 21, an upper seal assembly 21U arranged on the upper surface side of the housing 21, and a lower seal assembly 21L arranged on the lower surface side of the housing 21. A drive shaft 22 is projected out of the lower seal assembly 21L. The drive shaft 22 is coupled to a drive mechanism of the pump unit (see FIG. 2) and is rotated by the drive of the drive motor.

Figure 10:
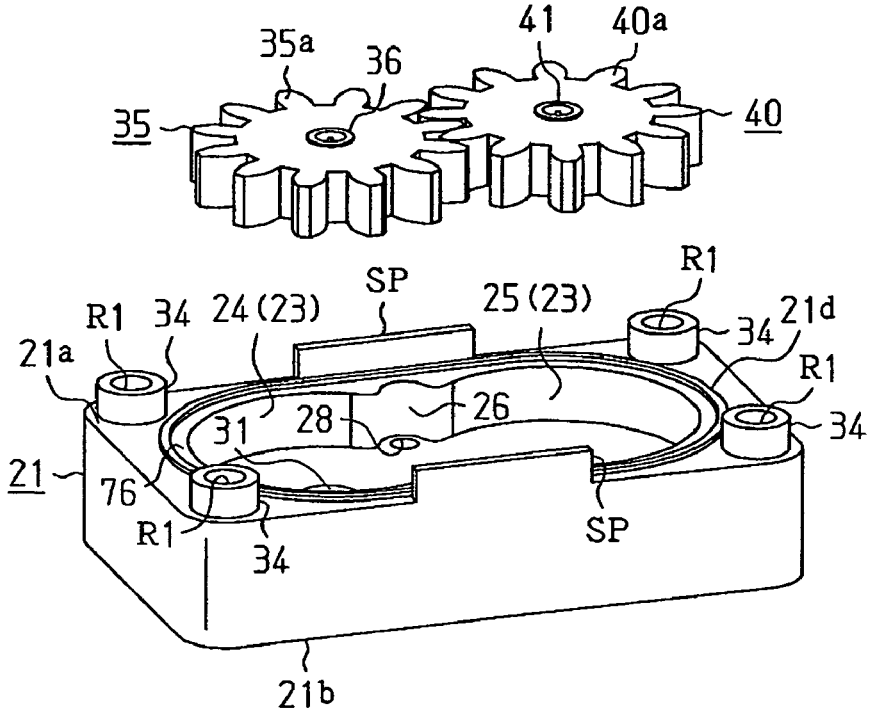
FIGS. 10 and 11 are perspective views showing a housing and each gear of the gear pump shown in FIG. 8.
Figure 11:
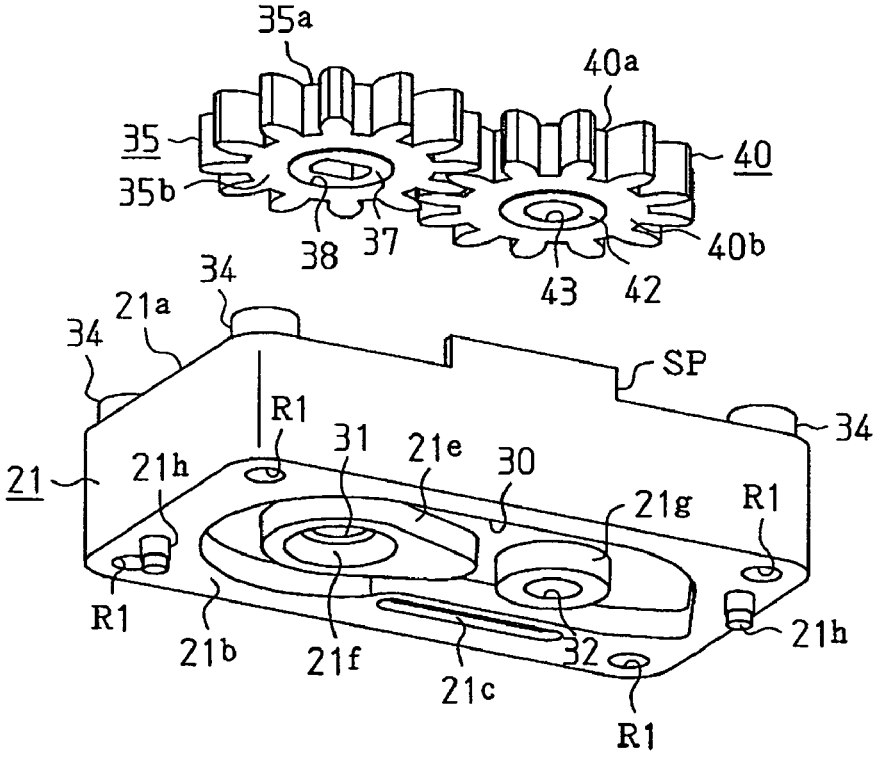
Figure 12:
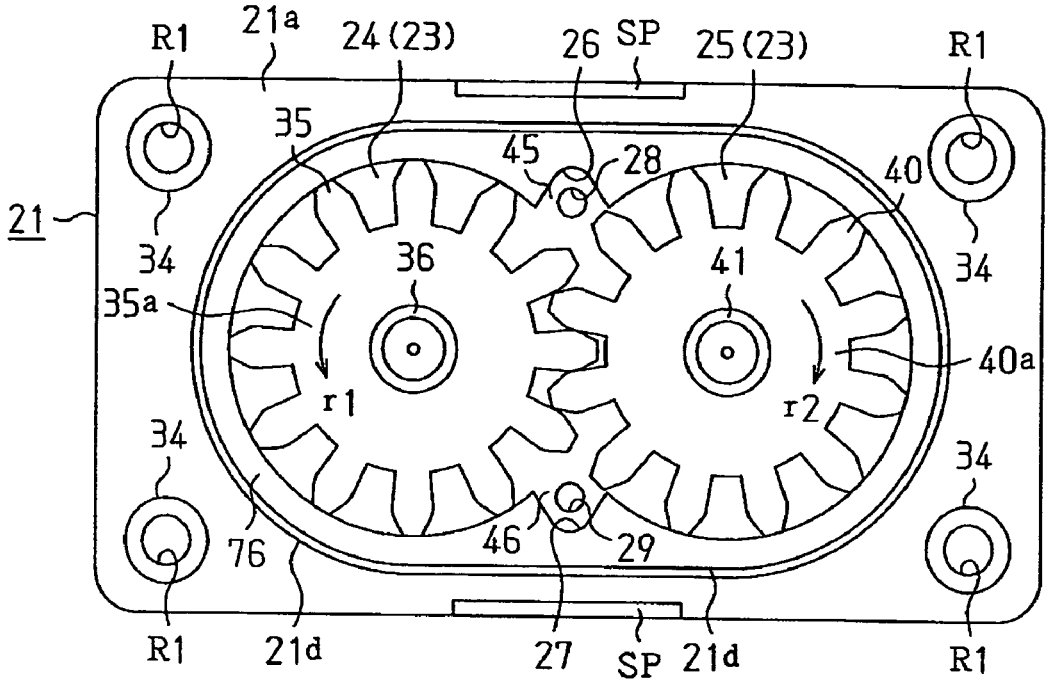
FIG. 12 is a plan view showing the housing in a state accommodating each gear.

The housing 21 will be described in accordance with FIGS. 10 to 13. FIGS. 10 and 11 are perspective views showing the housing 21 and the drive gear 35 and the driven gear 40 accommodated in the housing 21. FIG. 12 is a plan view showing the housing 21 accommodating the drive gear 35 and the driven gear 40, and FIG. 13 is a bottom view of the housing 21.

As shown in FIG. 10, the housing 21 is generally box-like and includes an upper surface 21*a* and a lower surface 21*b*. An accommodation chamber (accommodation recess) 23 for accommodating the drive gear 35 and the driven gear 40 is formed in the upper surface 21*a*. The accommodation chamber 23 includes a first accommodation portion 24 and a second accommodation portion 25. As shown in FIG. 12, the first and second accommodation portions 24 and 25 are generally cylindrical. The first and second accommodation portions 24 and 25 partially overlap each other. A suction portion 26 and a discharge portion 27 are formed between the first accommodation portion 24 and the second accommodation portion 25 in the housing 21.

Figure 13:
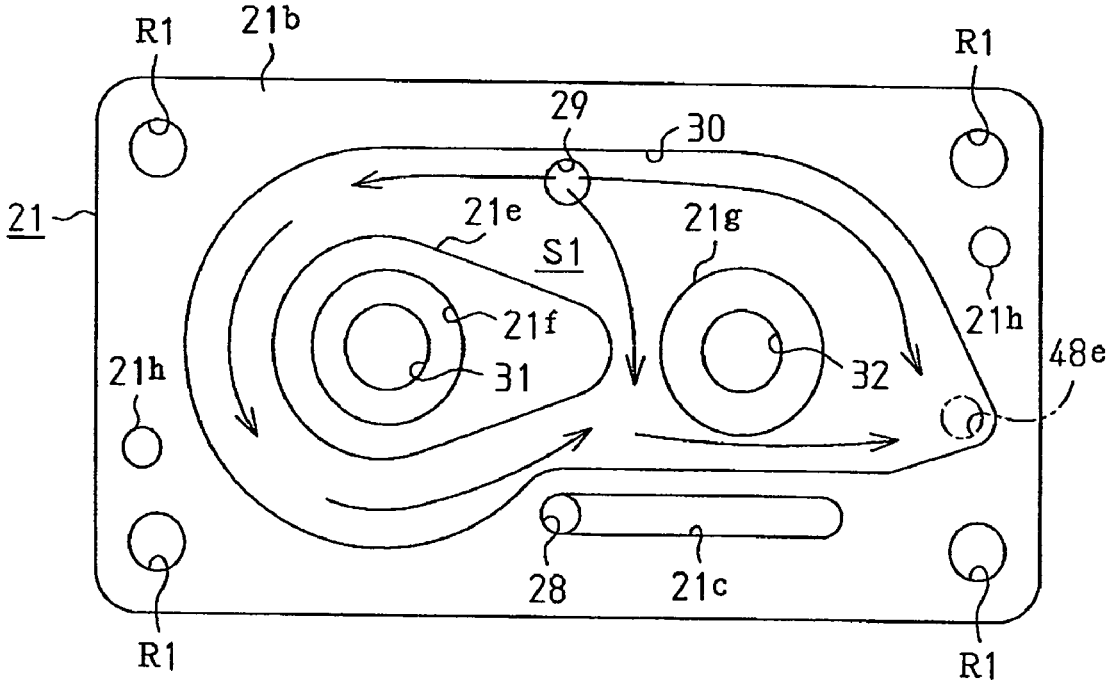
FIG. 13 is a bottom view showing the housing.

As shown in FIG. 13, an intake port 28 is connected to the suction portion 26 and a groove 21*c* formed in the lower surface 21*b* of the housing 21. As shown in FIG. 12, a discharge port 29 is connected to the discharge portion 27 and a hollow portion 30 formed in the lower surface 21*b* of the housing 21. The hollow portion 30 is formed in the lower surface 21*b* so as to avoid the groove 21*c*. As shown in FIG. 12, the upper surface 21*a* of the housing 21 includes a rib 21*d* serving as a pressing portion and having an oval shape so as to surround the opening of the accommodation chamber 23. The rib 21*d* is spaced from the opening edge of the accommodation chamber 23.

As shown in FIG. 11 and FIG. 13, a first shaft seat 21*e* projects out of the bottom surface of the hollow portion 30. The first shaft seat 21*e* has a generally wedge shape, and a recess 21*f* is formed in the center of the first shaft seat 21*e*. As shown in FIG. 13, a first shaft hole 31 is formed in the bottom surface of the recess 21*f*. The first shaft hole 31 extends through the housing 21 and is connected to the central position of the first accommodation portion 24. The drive shaft 22, which is coupled to the drive gear 35, is rotatably supported in the first shaft hole 31. The inner diameter of the first shaft hole 31 is greater than the outer diameter of the drive shaft 22. When the drive shaft 22 is received in the first shaft hole 31, a clearance is formed between the inner surface of the first shaft hole 31 and the outer surface of the drive shaft 22 (see FIG. 19).

As shown in FIG. 11, a second shaft seat 21*g* is formed next to the first shaft seat 21*e* in the hollow portion 30. The second shaft seat 21*g* is generally cylindrical, and a second shaft hole 32 is formed in the center of the second shaft seat 21*g*. The second shaft hole 32 extends through the housing 21 and is connected to the central position of the second accommodation portion 25. The second shaft hole 32 supports a driven shaft 44 (see FIG. 9) of the driven gear 40.

As shown in FIG. 10, a cylindrical projection 34 is formed in the four corners on the upper surface 21*a* of the housing 21. Each cylindrical projection 34 has a screw hole R1 into which a bolt BT shown in FIG. 9 is screwed, and the screw hole R1 extends through the housing 21 and opens at the lower surface 21*b*. Opposing support plates SP are formed on the upper surface 21*a*.

The drive gear 35 and the driven gear 40 will now be described. As shown in FIG. 11, the drive gear 35 is a spur gear with a first shaft hole 38 formed in its center. The first shaft hole 38 is a generally rectangular recess, and is open only in the lower surface 35*b*. As shown in FIG. 10, an annular projection 36 is formed on the upper surface 35*a* of the drive gear 35. As shown in FIG. 11, an annular projection 37 is formed around the first shaft hole 38 on the lower surface 35*b* of the drive gear 35. The height of the annular projections 36 and 37 is less than or equal to 50 μm. The outer diameter of the annular projection 36 formed on the upper surface 35*a* is smaller than the outer diameter of the annular projection 37 formed on the lower surface 35*b*.

As shown in FIG. 11, the driven gear 40 meshed with the driven gear 35 is a spur gear including a second shaft hole 43 formed in its center. The second shaft hole 43 is open only in the lower surface 40*b*. Further, as shown in FIG. 10, an annular projection 41 is formed on the upper surface 40*a* of the driven gear 40. As shown in FIG. 11, an annular projection 42 is formed around the second shaft hole 43 on the lower surface 40*b*. The height of the annular projections 41 and 42 is less than or equal to 50 μm in the same manner as the annular projections 36 and 37 formed on the drive gear 35. The outer diameter of the annular projection 41 formed on the upper surface 40*a* is smaller than the outer diameter of the annular projection 42 formed on the lower surface 40*b*.

As shown in FIG. 12, the drive gear 35 and the driven gear 40 are accommodated in the first accommodation portion 24 and the second accommodation portion 25, respectively, in a state meshed with each other. The drive shaft 22 (See FIG. 9) extends through the first shaft hole 31 of the housing 21 and is inserted in the first shaft hole 38 from the lower surface 35*b* of the drive gear 35. Further, the driven shaft 44 (see FIG. 9) extends through the second shaft hole 32 of the housing 21 and is inserted in the second shaft hole 43 from the lower surface 40*b* of the driven gear 40.

As shown in FIG. 12, the suction chamber 45 and the discharge chamber 46 are defined in the accommodation chamber 23 by the drive gear 35 and the driven gear 40. The suction chamber 45 and the discharge chamber 46 are arranged so as to sandwich the meshing position of the drive gear 35 and the driven gear 40. The suction portion 26 forms a side surface of the suction chamber 45, and the discharge portion 27 forms a side surface of the discharge chamber 46.

Ink from an external device flows in to the suction chamber 45 through the groove 21*c* and the intake port 28 formed in the housing 21. When the drive gear 35 and the driven gear 40 are rotated in the r1 direction and the r2 direction in FIG. 11, respectively, by the rotation of the drive shaft 22, the ink in the suction chamber 45 (suction position) is enclosed in a space defined by the inner surface of the accommodation chamber 23 and the teeth grooves of the drive gear 35 and the driven gear 40 to be transferred to the discharge chamber 46 (discharge position). When the teeth tips of the drive gear 35 and the driven gear 40 move away from the inner surface of the accommodation chamber 23, the enclosed ink is discharged to the discharge chamber 46. The suction chamber 45 then enters a relatively low pressure state, and the discharge chamber 46 enters a relatively high pressure state. The ink within the discharge chamber 46 is forced out to the hollow portion 30 formed in the lower surface 21*b* of the housing 21 through the discharge port 29 by the pressure of the ink sequentially sent out from the gears 35 and 40.

Figure 14:
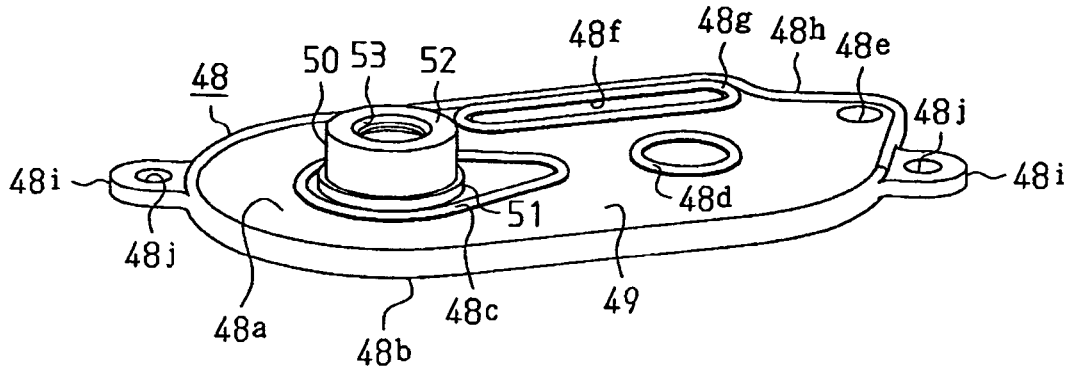
FIG. 14 is a perspective view showing a shaft seal member configuring a lower seal assembly of the gear pump shown in FIG. 8.
Figure 15:
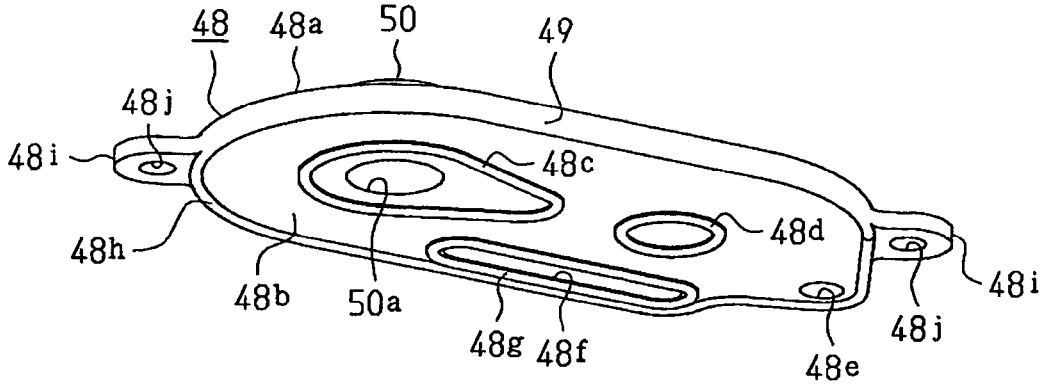
FIG. 15 is a perspective view showing the shaft seal member.
Figure 16:
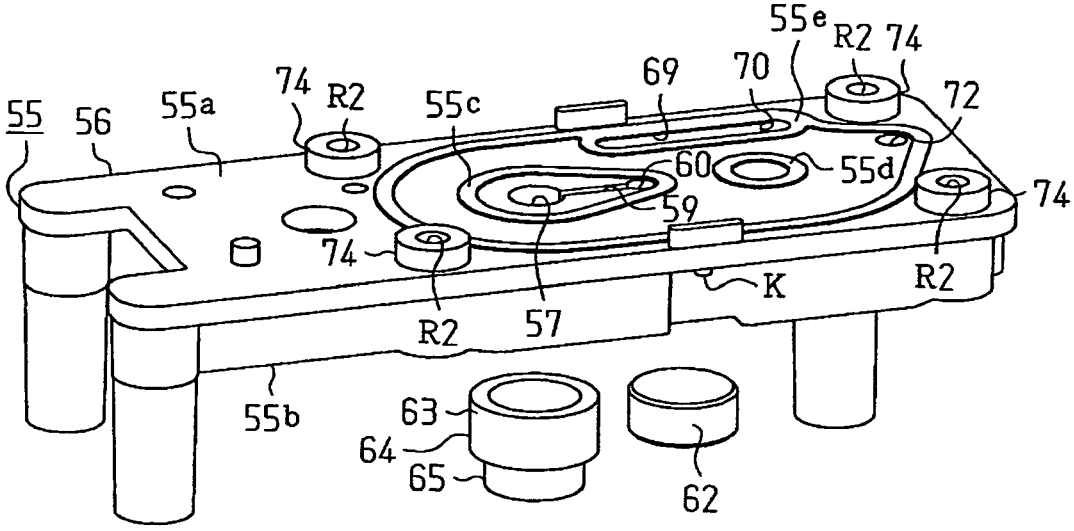
FIG. 16 is a perspective view showing a lower cover forming the lower seal assembly.
Figure 17:
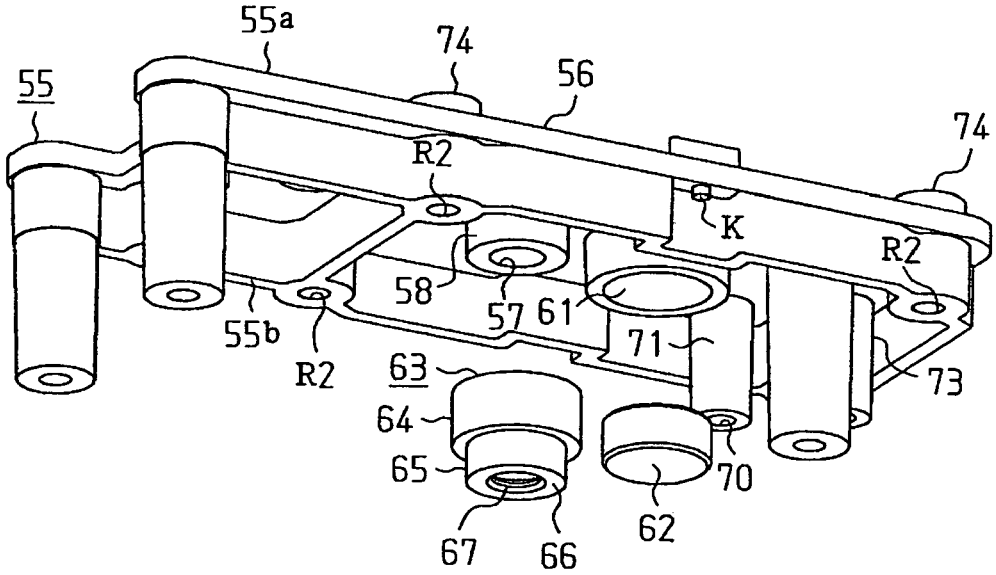
FIG. 17 is a perspective view showing the lower cover.
Figure 18:
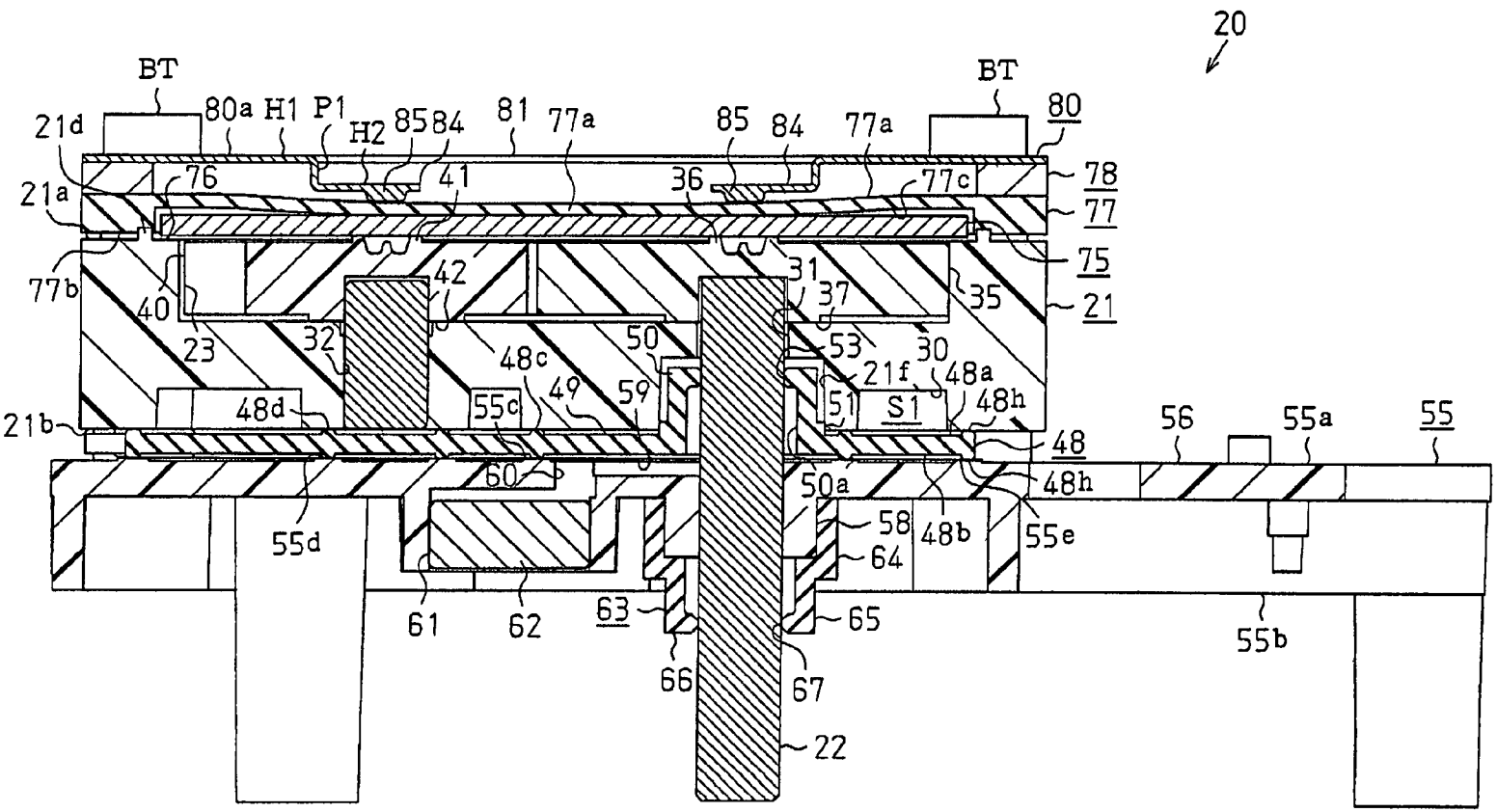
FIG. 18 is a cross-sectional view of the gear pump of FIG. 8.
Figure 19:
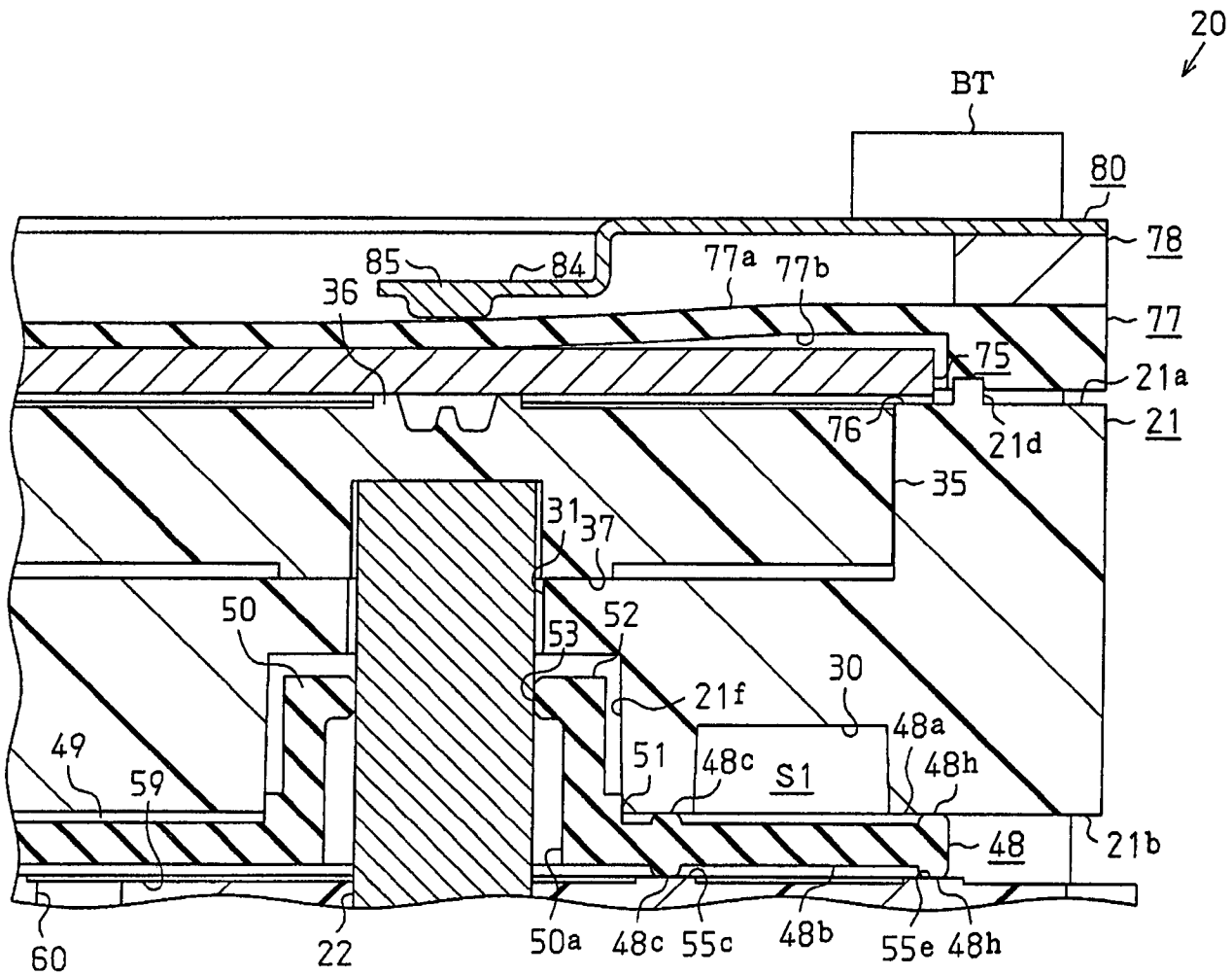
FIG. 19 is an enlarged cross-sectional view of the gear pump of FIG. 8.
Figure 20:
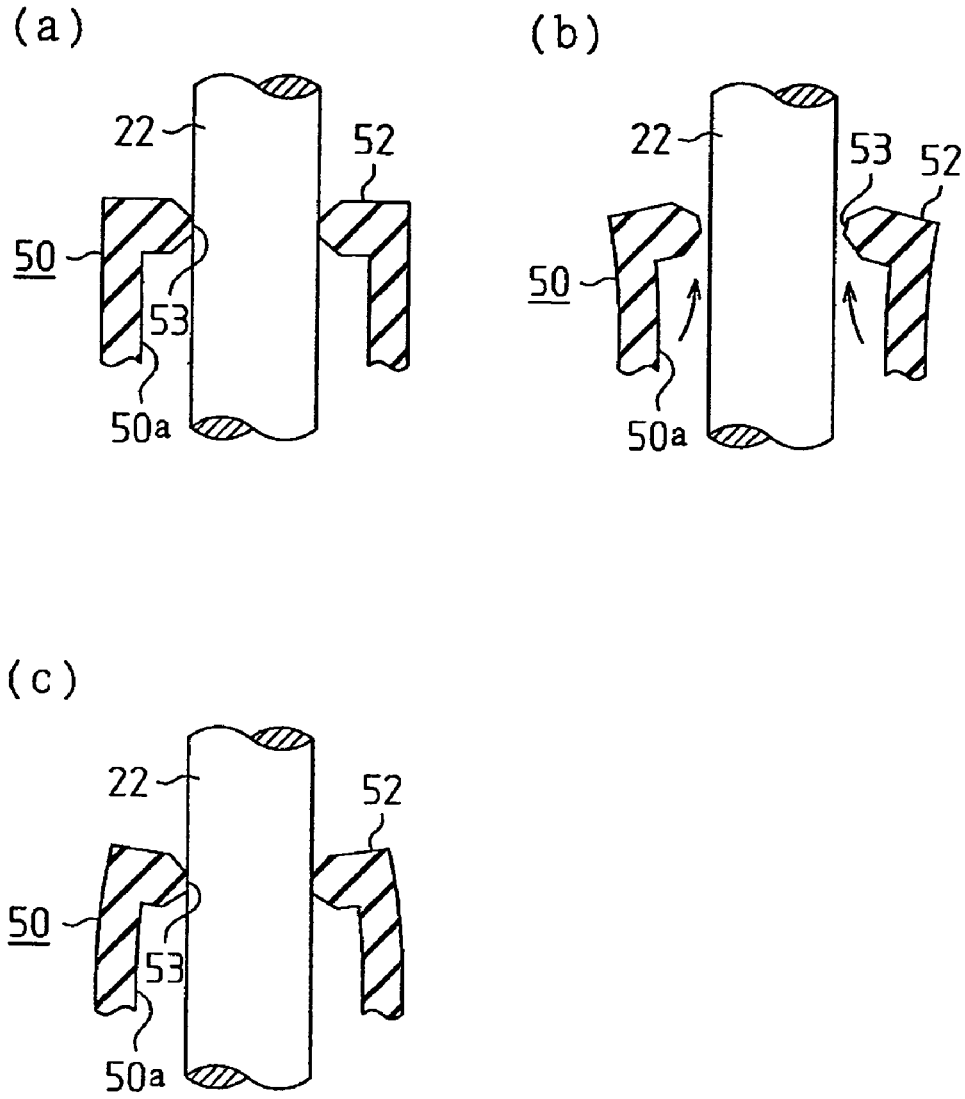
FIG. 20(*a*), 20(*b*), and 20(*c*) are explanatory diagrams each showing the operation of the shaft seal member in a sealed state, an enlarged state, and a diameter reduced state in which the external pressure is high.

The lower seal assembly 21L for closing the hollow portion 30 of the housing 21 will now be described. The lower seal assembly 21L includes a shaft seal member 48 and a lower cover 55, as shown in FIG. 9. FIGS. 14 and 15 are perspective views of the shaft seal member 48, FIGS. 16 and 17 are perspective views of the lower cover 55, and FIGS. 18 and FIG. 19 are cross-sectional views of the gear pump 20. FIG. 20 shows the operation of the shaft seal member 48.

First, the shaft seal member 48 will be described. The shaft seal member 48 is made of a flexible material, such as elastomer. As shown in FIG. 14, the shaft seal member 48 includes a plate-shaped platform 49 and a first seal portion 50 serving as a one-way valve formed on the upper surface 48*a* of the platform 49. The first seal portion 50 is cylindrical and has a lid 52. The base 51 of the first seal portion 50 is thick. The lid 52 has an opening 53. As shown in FIG. 15, the shaft hole 50*a* formed in the first seal portion 50 is connected to the lower surface 48*b*. First seal lips 48*c* having a generally wedge shape are formed on the upper surface 48*a* and the lower surface 48*b* of the platform 49 so as to surround the first seal portion 50.

As shown in FIGS. 14 and 15, annular second seal lips 48*d* are formed on the right side of the first seal portion 50 on the upper surface 48*a* and the lower surface 48*b* of the platform 49. Communication holes 48*e* and 48*f* are formed between the second seal lips 48*d* and the edge of the platform 49. The communication hole 48*e* is formed near the right end of the platform 49. The communication hole 48*f* is elongated and formed to be parallel to the longitudinal direction of the shaft seal member 48 at the edge of the shaft seal member 48 near the middle portion with respect to the longitudinal direction. Third seal lips 48*g* are formed on the upper surface 48*a* and the lower surface 48*b* of the platform 49 so as to surround the communication hole 48*f*. Fourth seal lips 48*h* are formed along the peripheral edge of the platform 49 on the upper surface 48*a* and the lower surface 48*b* of the platform 49. Fastening tabs 48*i* extend from two locations at the outer end face of the platform 49. Each fastening tab 48*i* includes a hole 48*j*.

Two projections 21*h* are formed on the lower surface 21*b* of the housing 21. The two projections 21*h* are each received by the holes 48*j* of the two fastening tabs 48*i*, and the first seal portion 50 is fitted to the recess 21*f* of the first shaft seat 21*e* of the housing 21 to fix the shaft seal member 48 to the housing 21. As shown in FIG. 19, the base 51 of the first seal portion 50 is pressed in contact with the inner surface of the recess 21*f*. This maintains hermetic sealing of the space between the inner surface of the recess 21*f* and the outer peripheral surface of the base 51 of the first seal portion 50. Further, the drive shaft 22 contacts with and is received by the opening 53 of the first seal portion 50. The opening 53 is beveled, and the contact surface pressure between the inner surface of the opening 53 and the drive shaft 22 is increased to maintain hermetic sealing. A clearance is formed between the shaft hole 50*a* of the first seal portion 50 and the drive shaft 22. The shaft hole 50*a* is open in the lower surface 48*b* of the platform 49.

As shown in FIG. 18, the platform 49 is arranged on the lower surface 21*b* of the housing 21 so as to close the second shaft hole 32 of the housing 21. When the shaft seal member 48 is fixed to the housing 21, the communication hole 48*f* formed in the platform 49 communicates with the groove 21*c* formed in the lower surface 21*b* of the housing 21. The communication hole 48*e* formed in the platform 49 is arranged in the hollow portion 30 formed in the housing 21 (see FIG. 13). As shown in FIG. 18, the hollow portion 30 is sealed by the platform 49 of the shaft seal member 48, and a space S1 (see FIG. 13 and FIG. 18) is defined by the hollow portion 30 and the upper surface 48*a* of the platform 49.

The lower cover 55 will now be described with reference to FIGS. 16 and 17. The lower cover 55 includes a plate-shaped cover platform 56. Stepped surfaces are formed on opposite sides of the cover platform 56, and an engagement projection K is formed on each stepped surface. As shown in FIG. 16, the cover platform 56 has a generally wedge shaped first pressing portion 55*c* formed in the central part of the upper surface 55*a* of the lower cover 55. The first pressing portion 55*c* slightly projects out of the upper surface 55*a*. The first pressing portion 55*c* presses the first seal lip 48*c* formed on the shaft seal member 48 when the lower cover 55 is attached from the lower surface 48*b* of the shaft seal member 48.

Second and third pressing portions 55*d* and 55*e* are formed on the upper surface 55*a* of the lower cover 55. The second pressing portion 55*d* is a projection formed on the right side of the first pressing portion 55*c* as viewed in FIG. 16. When the lower cover 55 is attached to the lower surface 48*b* of the shaft seal member 48, the second pressing portion 55*d* presses the second seal lip 48*d* of the shaft seal member 48. The third pressing portion 55*e*, which is a generally elliptical projection, presses the third and the fourth seal lips 48*g* and 48*h* of the shaft seal member 48.

As shown in FIG. 16, a first shaft hole 57 is formed in the inner side of the first pressing portion 55*c*. The first shaft hole 57 extends through the cover platform 56 and a first shaft seat 58 formed in the bottom surface 55*b* of the lower cover 55. Further, a linear air groove 59 for connecting the first shaft hole 57 and an air hole 60 is formed in the upper surface 55*a* of the lower cover 55. As shown in FIG. 18, the air hole 60 connects the upper surface 55*a* of the cover platform 56 to the interior of a resistor accommodation portion 61 formed in the bottom surface 55*b*. As shown in FIG. 17, the resistor accommodation portion 61 is cylindrical and opens at the bottom surface 55*b* of the lower cover 55. A flow resistor 62 made of a porous metal material (sintered metal) is fitted to the resistor accommodation portion 61. The flow resistor 62 functions to limit the amount of air flowing into the air hole 60.

A second seal portion 63 is fitted to the first shaft seat 58. The second seal portion 63 is made of a flexible material such as, elastomer, and includes a large diameter portion 64 and a small diameter portion 65. The large diameter portion 64 is generally cylindrical and has an inner diameter to enable an interference fit with the first shaft seat 58. The small diameter portion 65 is a cylinder with a closed bottom and has a slightly larger inner diameter than the outer diameter of the drive shaft 22. An opening 67 is formed in the bottom 66 of the small diameter portion 65. The drive shaft 22 is received in the opening 67 in a slidable manner. The opening 67 is beveled (see FIG. 18).

As shown in FIG. 18, when the second seal portion 63 is fitted to the lower cover 55, the drive shaft 22 projects out of the opening 67 of the attached second seal portion 63. The opening 67, which increases the contact surface pressure with respect to the drive shaft 22, maintains hermetic sealing so that air does not flow into the first shaft hole 57 through gaps. In the same manner as the first seal portion 50, the second seal portion 63 functions as a seal preventing air from flowing into the housing 21.

As shown in FIG. 16, an intake groove 69 is formed at the edge of the upper surface 55*a* of the cover platform 56. The intake groove 69 is connected to an intake hole 70. As shown in FIG. 17, an intake portion 71 is formed in the bottom surface 55*b* of the lower cover 55. The intake hole 70 opens at the lower surface of the intake portion 71.

As shown in FIG. 16, a discharge hole 72 is formed in a corner at the inner side of the third pressing portion 55*e* of the cover platform 56. The discharge hole 72 extends through the cover platform 56 and through a discharge portion 73 formed in the bottom surface 55*b* of the lower cover 55 and opens at the lower surface of the discharge portion 73.

As shown in FIG. 16, cylindrical projections 74 are formed at four locations in the upper surface 55*a* of the lower cover 55. Each cylindrical projection 74 has a screw hole R2 into which a bolt BT is screwed. The screw hole R2 extends through the cover platform 56 and opens at the bottom surface 55*b* of the lower cover 55.

The lower cover 55 is arranged on the lower surface 48*b* of the shaft seal member 48 fixed to the lower surface 21*b* of the housing 21. When each bolt BT screwed to each screw hole R1 of the housing 21 is screwed to each screw hole R2 of the lower cover 55 and fastened with a nut (not shown), the lower cover 55 is fixed to the housing 21 with the shaft seal member 48 arranged in between. The intake hole 70 formed in the intake portion 71 of the lower cover 55, the intake groove 69, the communication hole 48*f* formed in the shaft seal member 48, and the groove 21*c* formed in the housing 21 are connected to one another. That is, the intake hole 70 is connected to the accommodation chamber 23 through the intake groove 69, the communication hole 48*f*, the groove 21*c*, and the intake port 28.

The discharge hole 72 of the lower cover 55, the communication hole 48*e* of the shaft seal member 48, the hollow portion 30 of the housing 21, and the platform 49 of the shaft seal member 48 define a space S1. That is, the discharge hole 72 is connected to the accommodation chamber 23 through the communication hole 48*e*, the space S1, and the discharge port 29.

Ink drawn into the intake hole 70 of the lower cover 55 is sent to the suction chamber 45 through the intake groove 69, the communication hole 48*f*, the groove 21*c*, and the intake port 28. The ink is transferred from the suction chamber 45 to the discharge chamber 46 by the rotation of the drive gear 35 and the driven gear 40 and discharged into the space S1 (see FIG. 13) through the discharge port 29. In the space S1, the ink flows through the periphery of the first shaft seat 21*e*, the gap between the first shaft seat 21*e* and the second shaft seat 21*g*, and between the second shaft seat 21*g* and the inner surface of the hollow portion 30 towards the communication hole 48*e* of the shaft seal member 48, as shown by the arrows in FIG. 13. The ink is then discharged outside through the communication hole 48*e* and the discharge hole 72 of the lower cover 55.

As shown in FIG. 18, when the lower cover 55 and the shaft seal member 48 are fixed to the housing 21, the interior of the resistor accommodation portion 61 of the lower cover 55 is connected to the shaft hole 50*a* of the shaft seal member 48 through the air hole 60 and the air groove 59 of the lower cover 55. That is, air passing through the flow resistor 62 can flow into the first seal portion 50 through the air hole 60 and the air groove 59. However, since the amount of air flowing into the first seal portion 50 is limited by the flow resistor 62, a difference between the internal pressure and the external pressure of the first seal portion 50 is generated. The pressure difference deflects the lid 52 of the first seal portion 50 (see FIG. 19). The resistor accommodation portion 61, the air hole 60, the air groove 59, the shaft hole 50*a*, the recess 21*f*, and the first shaft hole 31 form a communication passage for connecting the exterior of the housing 21 and the accommodation chamber 23.

More specifically, as shown in FIG. 19, the recess 21*f* for accommodating the first seal portion 50 is connected to the first accommodation portion 24 through the gap between the first shaft hole 31 and the drive shaft 22. Thus, the pressure of the first accommodation portion 24 acts on the lid 52 of the first seal portion 50 as the external pressure. If the pressure of the first accommodation portion 24 is lower than the internal pressure of the first seal portion 50 and greater than or equal to a predetermined value, the lid 52 is not deflected, as shown in FIG. 20(*a*). Conversely, if the external pressure of the first seal portion 50 is lower than the internal pressure and less than the predetermined value (negative pressure state), the lid deflects towards the first accommodation portion 24 (external side) and enlarges the opening 53, as shown in FIG. 20(*b*). The inner surface of the opening 53 moves away from the outer surface of the drive shaft 22 and generates a non-hermetic state. Thus, the air in the shaft hole 50*a* of the first seal portion 50 flows from the opening 53 to the recess 21*f* (see FIG. 19) of the housing 21. The air entering the recess 21*f* flows into the first accommodation portion 24 through the gap between the first shaft hole 31 of the housing 21 and the drive shaft 22. The air flowing into the first accommodation portion 24 flows as bubbles of air into locations of relatively low pressure, such as, the space between the teeth grooves of the gears 35 and 40 and the internal peripheral surface of the accommodation chamber 23, and then expands. When the gears 35 and 40 rotate and the teeth tips reach the discharge chamber 46 and then move away from the inner surface of the accommodation chamber 23, the air bubbles are discharged to the discharge chamber 46, which has a relatively high pressure, in a contracted state. As a result, ink is prevented from rapidly flowing in the discharge chamber 46.

If, for some reason, the pressure (external pressure) on the first accommodation portion 24 becomes greater than the internal pressure of the first seal portion 50, the lid 52 is deflected inward. This reduces the diameter of the opening 53 and the hermetic seal between the inner surface of the opening 53 and the outer surface of the drive shaft 22 is maintained, as shown in FIG. 20(*c*). That is, the first seal portion 50 functions as a one-way valve allowing the flow of air from the external side of the housing 21 to the accommodation chamber 23 only when the accommodation chamber 23 is in a negative pressure state.

As shown in FIG. 18, the shaft seal member 48 sandwiched between the lower cover 55 and the housing 21 maintains the hermetic seal of the space S1 formed between the hollow portion 30 of the housing 21 and the shaft seal member 48 by pressing the fourth seal lip 48*h* between the third pressing portion 55*e* of the lower cover 55 and the lower surface 21*b* of the housing 21. Further, the third seal lip 48*g* of the shaft seal member 48 is pressed between the third pressing portion 55*e* and the lower surface 21*b* around the groove 21*c* of the housing 21. This seals the communication hole 48*f* of the shaft seal member 48 and the intake groove 69 of the lower cover 55 in an air-tight state and keeps the path of ink flow hermetic. Further, the first and the second seal lips 48*c* and 48*d* of the shaft seal member 48 are pressed between the first and the second pressing portions 55*c* and 55*d* and the first and the second shaft seats 21*e* and 21*g* of the housing 21. This seals the first and second shaft holes 31 and 32 in a hermetic state.

Figure 21:
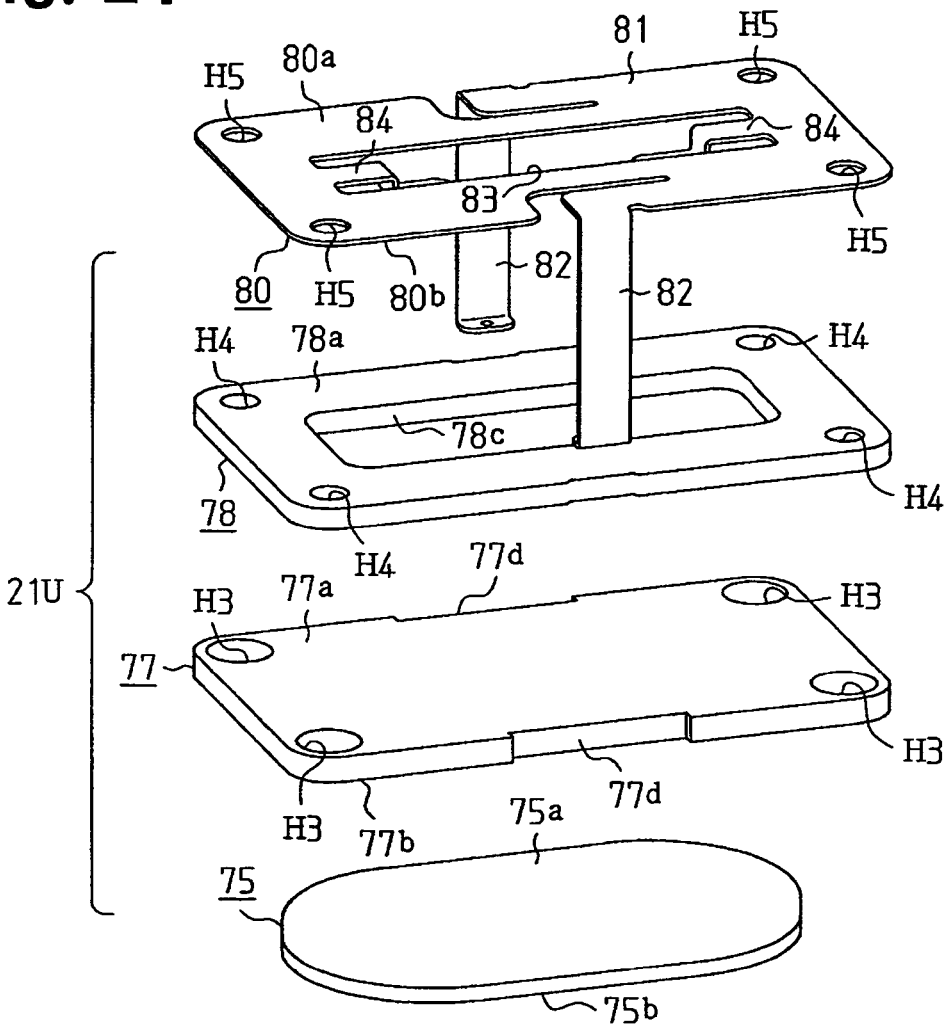
FIG. 21 is an exploded perspective view of an upper seal assembly of the gear pump of FIG. 8.
Figure 22:
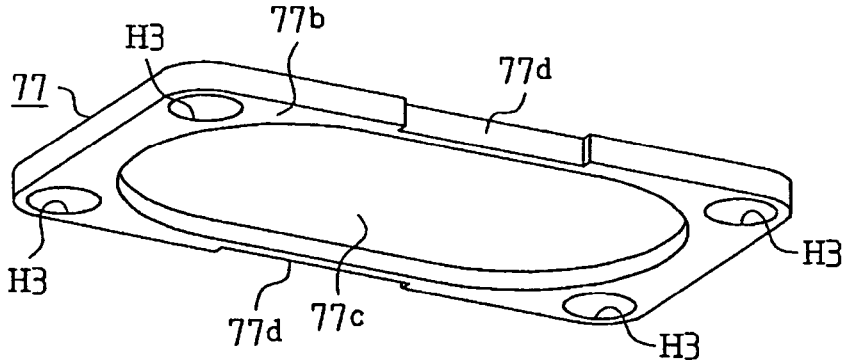
FIG. 22 is a perspective view showing a packing forming the upper seal assembly.
Figure 23:
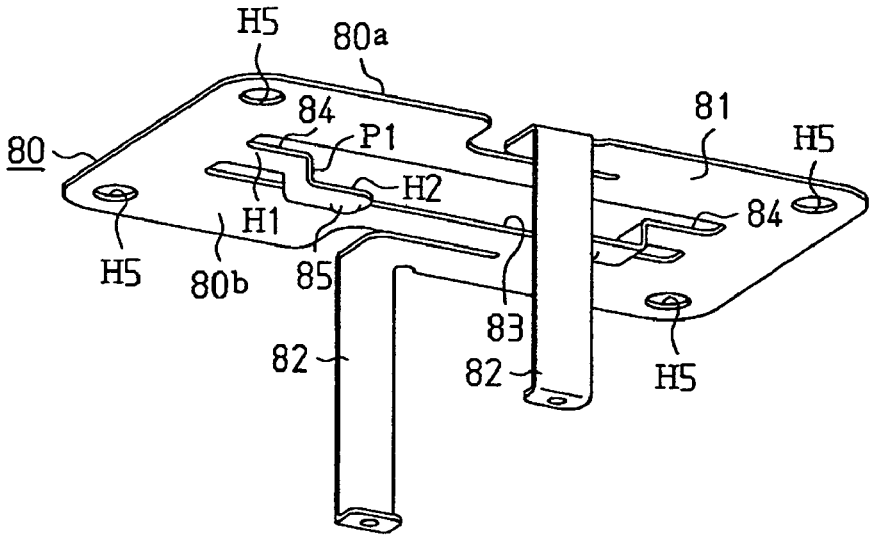
FIG. 23 is a perspective view showing a restriction member forming the upper seal assembly.

The upper seal assembly 21U will now be described with reference to FIGS. 21 to 23. FIG. 21 is an exploded perspective view of the upper seal assembly 21U. As shown in FIG. 21, the upper seal assembly 21U includes a sealing plate 75 serving as a first sealing element, a packing 77 serving as a second sealing element, a push plate 78, and a restriction member 80 serving as a biasing means. FIG. 22 is a perspective view of the packing 77, and FIG. 23 is a perspective view of the restriction member 80.

As shown in FIG. 21, the sealing plate 75 is a generally elliptical metal plate. The sealing plate 75 is arranged on an upper surface 21*a* of the housing 21 so as to be positioned at the inner side of the rib 21*d*, as shown in FIG. 18 and FIG. 19. The surface of the sealing plate 75 facing towards the accommodation chamber 23 is positioned in the axial direction of each gear by contacting the annular projections 36 and 41 of the drive gear 35 and the driven gear 40 accommodated in the accommodation chamber 23. As a result, a slight gap is formed between the sealing plate 75 and the upper surface 21*a* of the housing 21.

The packing 77 is attached to the outer side of the sealing plate 75. As shown in FIG. 21, the packing 77 is made of a flexible material such as, an elastomer, and is a generally rectangular plate sized to cover the opening of the accommodation chamber 23. As shown in FIG. 22, a recess 77*c* is formed in the lower surface 77*b* of the packing 77. Further, support portions 77*d* are formed on opposite sides of the packing 77. Four bolt holes H3 for receiving the four bolts BT are formed in the corners of the packing 77. As shown in FIG. 18, the packing 77 is arranged from above the sealing plate 75.

When pressing force is externally applied, the lower surface 77*b* of the packing 77 is pressed against the rib 21*d* of the housing 21 and the pressed part is elastically deformed and adhered to the rib 21*d*. Consequently, the opening of the accommodation chamber 23 is sealed in a hermetic manner. Further, the sealing plate 75 is accommodated in the recess 77*c* of the packing 77. Here, the bottom surface of the recess 77*c* of the packing 77 and the sealing plate 75 are not pressed.

The push plate 78 is attached to the upper surface 77*a* of the packing 77. As shown in FIG. 21, the push plate 78 is a square frame including a center opening 78*c*. Four bolt holes H4 for receiving the bolts BT are formed in the corners of the push plate 78. The restriction member 80 is attached to the upper surface 78*a* of the push plate 78.

As shown in FIG. 21, the restriction member 80 includes a generally frame shaped body 81 and two arms 82 extending downward from opposite sides of the body 81. Each arm 82 is generally L-shaped, with the distal end bent inward. A hole is formed in the distal end of the arm 82. Bolt holes H5 for receiving the bolts BT are formed in the corners of the body 81.

As shown in FIG. 8 and FIG. 23, two restriction portions 84 are formed on opposite sides of an opening 83 formed in the body 81. Each restriction portion 84 is formed by bending an elongated plate-like piece at two locations into a crank shape, as shown in FIGS. 8 and 23.

As shown by the left restriction portion 84 in FIG. 23, each restriction portion 84 includes a first horizontal part H1 extending inwardly, a vertical part P1 extending downward in the vertical direction from the first horizontal part, and a second horizontal part H2 bent inwardly from the vertical part. A pressing part 85 is pressed and projected in the lower surface of the second horizontal part H2. The vertical part P1 of the restriction portion 84 has a length that is substantially the same as the thickness of the push plate 78.

As shown in FIG. 8, when the restriction member 80 is attached from above to the push plate 78, the engagement projections K of the lower cover 55 engage the holes in the distal ends of the arms 82 of the restriction member 80. Further, the packing 77 is arranged so as to be fitted to the inner sides of the support plate SP of the housing 21. In this state, the arms 82 are fitted into the support portions 77*d* of the packing 77. Bolts are received in the bolt holes H3 to H5, and nuts (not shown) are fastened to the distal ends of the bolts BT projecting from the screw holes R2 of the lower cover 55.

As a result, the push plate 78, the packing 77, the sealing plate 75, and the housing 21 are fixed to the lower cover 55 by the restriction member 80. Then, as shown in FIGS. 8 and 18, the pressing part 85 of the restriction member 80 contacts the upper surface 77*a* of the packing 77, and the contacting surface is pressed downward. The pressing parts 85 of the restriction portion 84 are arranged so as to lie along an axial line extending from the axes of the drive gear 35 and the driven gear 40. That is, the restriction portion 84 presses the axis positions of the gears 35 and 50. Thus, as shown in FIG. 19, the sealing plate 75 contacts only the annular projections 36 and 41 of the gears 35, 40, and portions of the upper surfaces 35*a* and 40*a* other than the annular projections 36 and 41 do not contact the sealing plate 75. Further, as shown in FIG. 19, the packing 77 is pushed against the rib 21*d* by the fastening force of the bolt BT to seal the opening of the accommodation chamber 23 in a hermetic manner while restricting movement towards the sealing plate 75. Thus, even if the sealing plate 75 is not adhered to the upper surface 21*a* of the housing 21, the packing 77 seals the opening of the accommodation chamber 23 from the outer side.

The packing 77 is pressed against the housing 21 at the outer side of the sealing plate 75. Thus, the pressing force applied to the packing 77 is not applied to the sealing plate 75. For this reason, in the second embodiment, the packing 77 is pressed against the housing 21 with a relatively large pressing force.

The operation of the gear pump 20 will now be described. When performing cleaning, a lifting mechanism is driven, and the nozzle surface of the recording head 8 is sealed by the cap 12. When a drive command is output at a predetermined timing from a control section (not shown) of the printer 1, the drive motor is driven and the drive shaft 22 is rotated in the forward direction. As a result, the drive gear 35 is rotated in the r1 direction, and the driven gear 40 is rotated in the r2 direction due to the meshing with the drive gear 35, as shown in FIG. 12.

In this state, the annular projections 36 and 41 formed on the upper surfaces 35*a* and 40*a* of the gears 35 and 40 is biased toward the bottom surface of the accommodation chamber 23 by the restriction portion 84 of the restriction member 80. Further, the annular projections 37 and 42 formed in the lower surfaces 35*b* and 40*b* of the gears 35 and 40 are also biased toward the housing 21 by the restriction portion 84. Therefore, the annular projections 36, 37, 41, and 42 of the gears 35 and 40 each contact the sealing plate 75 and the housing 21, and the other parts of the upper surfaces 35*a* and 40*a* and the lower surfaces 35*b* and 40*b* are rotated while maintaining a non-contact state in which they do not move along the sealing plate 75 and the housing 21. As a result, the diameter and contact area of the portion of contact between the sealing plate 75 or the housing 21 and the gears 35 and 40 becomes small. This reduces the load applied to the gears 35 and 40.

When the drive gear 35 and the driven gear 40 are rotated, the ink in the suction chamber 45 is enclosed in the space defined by the teeth grooves of the drive gear 35 and the driven gear 40 and the inner surface of the accommodation chamber 23 and sequentially sent to the discharge chamber 46. Thus, the suction chamber 45 is temporarily in a low-pressure state. The ink in the cap 12 then flows into the suction chamber 45 through the tube 13 to eliminate the low-pressure state of the suction chamber 45. In this state, the pressure of the suction chamber 45 is low compared to the pressure of the discharge chamber 46. However, due to the contact of the annular projections 36, 37, 41, and 42 with the sealing plate 75 and the housing 21, the gap between the upper surfaces 35*a* and 40*a* of the gears 35 and 40 and the sealing plate 75 and the gap between the lower surfaces 35*b* and 40*b* and the housing 21 are less than or equal to 50 μm. Thus, the amount of ink flowing into the suction chamber 45 from the discharge chamber 46 through the gaps becomes small and the suction capability is not lowered by a reverse flow of the ink.

Further, when high speed rotation of the drive gear 35 and the driven gear 40 causes the pressure of the first accommodation portion 24 to be less than a predetermined value, the lid 52 of the first seal portion 50 is deflected toward the first accommodation portion 24 due to the pressure difference between the internal pressure and the external pressure of the first seal portion 50, as shown in FIG. 20(*b*). As a result, the opening 53 is enlarged, and the air passing the flow resistor 62 flows into the first accommodation portion 24 through the air hole 60, the air groove 59, and the first shaft hole 31. Even if a negative pressure is generated in the accommodation chamber 23, as long as the pressure is greater than or equal to the predetermined value, the lid 52 does not deflect towards the accommodation chamber 23 as shown in FIG. 20(*a*).

The air that flows into the accommodation chamber 23 is drawn into the suction chamber 45, which has a relatively low pressure, and into the teeth grooves of the drive gear 35 and the driven gear 40 in a bubbled state. The air bubbles then expand in the space defined by the teeth grooves and the inner surface of the accommodation chamber 23, and contracts when discharged toward the discharge chamber 46. This slows the rapid flow of ink that is apt to occur in the vicinity of the discharge chamber 46. By preventing ink from flowing rapidly, the generation of noise that would result from such flow is prevented.

Ink flowing from the cap 12 to the suction chamber 45 and sent to the discharge chamber 46 by the drive gear 35 and the driven gear 40 is guided to the tube 15 connected to the discharge portion 73 through the discharge port 29, the space S1, the communication hole 48*e*, and the discharge hole 72. The ink flowing into the tube 15 is discharged into the waste ink tank 16. As a result, the ink and the air within the cap 12 is drawn out, the cap 12 enters a negative pressure state, and fluids of ink and air bubbles are discharged from the nozzle of the recording head 8.

The second embodiment has the advantages described below.

(1) The second embodiment employs the sealing plate 75, for sealing the accommodation chamber 23 of the gear pump 20 and preventing reverse flow of fluid from the discharge position to the suction position, and the packing 77, for sealing the accommodation chamber 23 in a hermetic state are included. The sealing plate 75 contacts the annular projections 36 and 41 of the drive gear 35 and the driven gear 40. Since the gaps between the sealing plate 75 and the upper surfaces 35*a* and 40*a* of the gears 35 and 40 become small, reverse flow of fluid from the discharge position to the suction position of the accommodation chamber 23 is prevented, and the suction and discharge operations of the pump are stabilized. Further, the packing 77 is made of a flexible material, such as elastomer, and is pressed against the rib 21*d*, which projects outward from the restriction surface 76 on the upper surface 21*a* of the housing 21. Thus, even if a gap is formed between the sealing plate 75 and the housing 21, the accommodation chamber 23 is maintained in a hermetic state. Further, the gear pump 20 is not enlarged.

The sealing plate 75 is pressed against the gears 35 and 40 only by the pressing force generated by the restriction portion 84 of the restriction member 80. This stabilizes the pressing force of the gears 35 and 40. Further, the gears 35 and 40 are not excessively pressed. This reduces the load applied to the gears 35 and 40. Accordingly, the sealing plate 75 prevents reverse flow in the accommodation chamber 23 while contacting the gears 35 and 40 with an appropriate pressing force.

The packing 77 is pressed against the rib 21*d* arranged on the outer side of the sealing plate 75 to functions as a seal. Thus, the pressing force, which is applied to the packing 77 by the fastening of the bolts BT, is not applied to the sealing plate 75. Thus, even if the packing 77 is pressed against the rib 21*d* with a large pressing force while taking into consideration deterioration of the packing 77 resulting from long use, the load applied to the gears 35 and 40 is not increased. The packing 77 may thus be pressed against the housing 21 with a relatively large force. Therefore, the seal of the accommodation chamber 23 is continuously ensured even if the gear pump 20 is used over a long period of time.

(2) The second embodiment employs the annular projections 36, 37, 41, and 42 contacting the sealing plate 75 and the housing 21 and arranged on the upper surface 35*a* and 40*a* and the lower surface 35*b* and 40*b* of the drive gear 35 and the driven gear 40. Portions other than the annular projection 36 and 41 on the upper surfaces 35*a* and 40*a* of the gears 35 and 40 are in a non-contact relation with the sealing plate 75. Further, portions other than the annular projections 37 and 42 on the lower surfaces 35*b* and 40*b* of the gears 35 and 40 are in a non-contact relation with the housing 21. Accordingly, the diameter of the portion of contact between the drive gear 35 and the driven gear 40 is a small. This reduces friction load. Moreover, since the areas along which the sealing plate 75 and the housing 21 move is small, the viscosity load during rotation of the gears 35 and 40 is reduced while preventing reverse flow in the accommodation chamber 23.

(3) In the second embodiment, the packing 77 is plate-shaped and is sized to cover the opening of the accommodation chamber 23. Since the packing 77 has a simple structure, the number of manufacturing steps or assembling steps is reduced. Further, since the packing 77 is plate-shaped, molding errors are unlikely to occur, and the reliability of the sealing effect is improved.

(4) In the second embodiment, the restriction members 80 include the restriction portions 84. The restriction portions 84 press the axis positions of the drive gear 35 and the driven gear 40 to the housing 21 with the sealing plate 75 and decrease the gaps of the sealing plate 75, the gears 35 and 40, and the housing 21. That is, as the restriction portions 84 press the axis positions of the gears 35 and 40, reverse flow of the ink in the accommodation chamber 23 is prevented. Since the restriction portion 84 presses the axis positions of the gears 35 and 40, portions other than the annular projections 36 and 41 of the gears 35 and 40 are prevented from contacting the sealing plate 75 and increasing the friction load of the gears 35 and 40.

(5) In the second embodiment, the rib 21*d* that is pressed against the packing 77 is formed on the housing 21. The area in which the packing 77 is pressed against becomes small. Thus, the packing 77 may be adhered to the rib 21*d* even with a relatively small pressing force. Accordingly, the opening of the accommodation chamber 23 is hermetically sealed.

(6) The second embodiment employs the resistor accommodation portion 61, the air hole 60, and the air groove 59 in the lower cover 55 to form an air flow passage extending from the exterior to the accommodation chamber 23. The first seal portion 50, which is connected to the air flow passage so that air flows into the accommodation chamber 23, is fitted to the recess 21*f* of the housing 21. The first seal portion 50 is formed so that parts excluding the base 51 may be deflected and the opening 53 is formed in the lid 52 of the first seal portion 50 to support the drive shaft 22 in a slidable manner. When the pressure of the first accommodation portion 24 is less than a predetermined value (negative pressure state), the opening 53 is enlarged towards the accommodation chamber 23. Thus, a non-hermetic state is generated between the inner surface of the opening 53 and the outer surface of the drive shaft 22. Accordingly, the air that flows into the first seal portion 50 through the air flow passage passes through the enlarged opening 53 and the drive shaft 22 and flows into the accommodation chamber 23. As a result, the air is mixed with the ink in the space defined by the teeth grooves of the gears 35 and 40 and the inner surface of the accommodation chamber 23. This lowers the pressure difference between the space and the discharge chamber 46 when ink is discharged towards the discharge chamber 46. The rapid flow of ink caused by the pressure difference in the vicinity of the discharge chamber 46 is thus eliminated, and vibrations and noise that would be caused by rapid ink flow is prevented.

Each embodiment may be modified as described below.

The biasing means of the first embodiment is not limited to a substantially U-shaped pressing spring, and may simply be any elastic member such as a compression spring or a plate spring as long the driven gear 127 is biased away from the discharge chamber 140.

In the first embodiment, the drive gear 126 and the driven gear 127 are positioned by the inner surfaces 124S, 125S of the accommodation chamber 123. Alternatively, only one of the gears may be positioned by the corresponding inner surface 124S or 125S.

In the first embodiment, the pressing springs 145 and 146 for biasing the driven gear 127 away from the discharge chamber 140 are arranged in the gear pump 20. The pressing springs 145 and 146 may be arranged to bias the drive gear 126 away from the discharge chamber 140. In this case, a groove is formed in the shaft hole 128 of the housing 121, and the pressing spring is press-fitted to the groove.

In the second embodiment, the gear pump 20 may be used not only as a suction pump but also as a pressurizing pump. For instance, fluid (air, ink) discharged by the gear pump 20 may be sent to an ink cartridge accommodating absorbent material to absorb waste ink with the absorbent material. In this case, in the fluid that is sent out of the gear pump 20, only the waste ink is absorbed by the absorbent material, and the case of the ink cartridge is filled with air. That is, in this case, the gear pump 20 functions as the pressurizing pump for sending the fluid to the ink cartridge. As a result, if an ink pack made of a flexible material is accommodated in the ink cartridge, the air filled in the case squeezes the ink pack and forces ink out of the ink pack and toward the recording head 8. In such case, the drive gear 35 and the driven gear 40 of the gear pump 20 are rotated at a high speed, and the pressure of the discharge chamber 46 becomes high. Since the gear pump 20 presses the drive gear 35 and the driven gear 40 with the restriction member 80, the gears 35 40 do not move freely.

Figure 24:
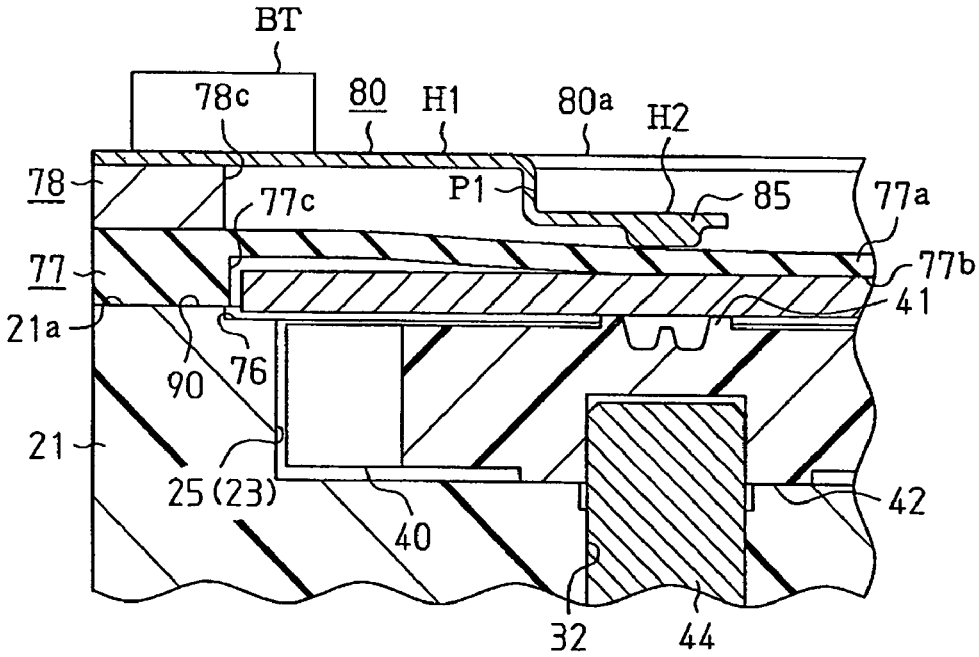
FIG. 24 is a partial cross-sectional view of a gear pump in a modification.

As shown in FIG. 24, a stepped surface 90 may be formed on the upper surface 21*a* of the housing 21. The packing 77 is pressed against the stepped surface 90 to be adhered to the packing 77 and the housing 21. Further, a projection may be arranged on the packing 77, and an engagement recess for engaging with the projection may be formed on the upper surface 21*a* of the housing 21 to adhere the packing 77 and the housing 21.

In the second embodiment, the first seal portion 50 is included in the air flow passage such as the air groove so that air flows into the accommodation chamber 23. However, when vibrations and noise caused by the pressure difference in the accommodation chamber 23 is not a concern, this structure may be eliminated. In this case, the structure of the gear pump 20 is further simplified.

The biasing means of the second embodiment may be changed to an elastic member such as a compression spring. In this case, the gear pump is enlarged. However, the pressing of the axes of the gears 35 and 50 is further ensured.

In the second embodiment, any of the annular projections 36, 37, 41, and 42 of the gears 35 and 40 may be omitted. Further, when the gears 35 and 40 are not likely to move during rotation and the load during rotation of the gears 35 and 40 is not particularly a concern, the annular projections 36, 37, 41, and 42 may all be omitted.

In the second embodiment, a gap (play) may be formed between the recess 77*c* of the packing 77 and the sealing plate 75 in a state in which the upper seal assembly 21U is attached to the housing 21. This further ensures that force applied to the packing 77 is prevented from being applied to the sealing plate 75.

The gear pump 20 of the second embodiment may be installed in devices other than the printer 1. The gear pump 20 functions to prevent suction failure or discharge failure in other devices and reduces the load of each gear (motor).

In the first and second embodiments, the gear pump 20 is installed in a so-called off-carriage type printer 1 in which the ink cartridge 10 is not mounted on the carriage 5. The gear pump 20 may also be installed in a printer of a type that mounts the ink cartridge on the carriage. Further, the gear pump 20 may be installed in devices other than a liquid injection apparatus.

In the first and the second embodiments, the printer 1 for discharging ink is described as a liquid injection apparatus. However, other types of liquid injection apparatuses may be used. For instance, the liquid injection apparatus may be a printing apparatus such as a fax or a copier, a liquid injection apparatus for injecting liquid such as electrode material or color material used in manufacturing a liquid crystal display, an EL display or a planar luminescence display, a liquid injection apparatus for injecting bio-organic material used in bio-chip manufacturing, or a sample injection apparatus serving as a precision pipette. Further, the fluid (liquid) is not limited to ink and may be other types of fluids (liquids).

It should be apparent to those skilled in the art that the present invention may be embodied in many other specific forms without departing from the spirit or scope of the invention.

What is claimed is:

1. A gear pump for discharging fluid, the gear pump comprising:

a housing defining an accommodation chamber including an opening, the fluid flowing into the accommodation chamber at a suction position and flows out of the accommodation chamber at a discharge position;

a drive gear and a driven gear, arranged in the accommodation chamber, for transferring the fluid from the suction position to the discharge position when rotated, the drive gear and the driven gear each having a projection;

a first sealing element, contacting at least part of the drive gear and the driven gear, closing the opening of the accommodation chamber, and preventing the fluid from flowing back to the suction position from the discharge position; and a second sealing element, arranged at an outer side of the first sealing element, for sealing the accommodation chamber in a hermetic state, wherein the first sealing element is positioned by contacting only with the projections of the drive gear and the driven gear and has no direct contact with the housing.

2. The gear pump according to claim 1, wherein the second sealing element is made of a flexible material.

3. The gear pump according to claim 1, wherein the drive gear and the driven gear each include side surfaces parallel to one another and having at least one of a projection contacting the first sealing element and a projection contacting the housing.

4. The gear pump according to claim 1, wherein the second sealing element is a plate member sized to cover the opening of the accommodation chamber.

5. The gear pump according to claim 1, further comprising a biasing means for biasing an axis position of each of the drive gear and the driven gear with the first sealing element.

6. The gear pump according to claim 5, wherein the biasing means presses the second sealing element at a position corresponding to each axis position and indirectly biases the first sealing element towards the axis position.

7. The gear pump according to claim 1, further comprising a pressing portion, formed on the housing, for pressing the second sealing element.

8. The gear pump according to claim 1, wherein the housing includes a communication path for connecting the exterior of the housing and the accommodation chamber, the gear pump further comprising:

a one-way valve, arranged in the communication path, for allowing air to flow from the exterior of the housing to the accommodation chamber when only the accommodation chamber is in a negative pressure state.

9. The gear pump according to claim 1, wherein the second sealing element completely covers the first sealing element.

10. A liquid injection apparatus comprising a gear pump according to claim 1.

* * * * *